US007374549B2

(12) United States Patent
Inada et al.

(10) Patent No.: US 7,374,549 B2
(45) Date of Patent: May 20, 2008

(54) MASSAGE MACHINE, MASSAGER FOR HANDS AND MASSAGING METHOD

(75) Inventors: Nichimu Inada, Osaka (JP); MyongSik Kim, Osaka (JP)

(73) Assignee: Family Co., Ltd., Osaka-shi (JP)

( * ) Notice: Subject to any disclaimer, the term of this patent is extended or adjusted under 35 U.S.C. 154(b) by 433 days.

(21) Appl. No.: 10/522,728

(22) PCT Filed: Jun. 28, 2004

(86) PCT No.: PCT/JP2004/009118

§ 371 (c)(1),
(2), (4) Date: Jan. 28, 2005

(87) PCT Pub. No.: WO2005/004782

PCT Pub. Date: Jan. 20, 2005

(65) Prior Publication Data

US 2006/0069325 A1 Mar. 30, 2006

(30) Foreign Application Priority Data

Jul. 11, 2003 (JP) ..... 2003-273680

(51) Int. Cl.
*A61H 1/00* (2006.01)

(52) U.S. Cl. ..... 601/84; 601/151

(58) Field of Classification Search ..... 601/84, 601/88, 97, 98, 99, 100, 101–103, 105, 148, 601/149, 150, 151, 152
See application file for complete search history.

(56) References Cited

U.S. PATENT DOCUMENTS 6,491,652 B1 * 12/2002 Hata et al. ..... 601/151
6,494,850 B1 * 12/2002 Kitadou et al. ..... 601/49

FOREIGN PATENT DOCUMENTS

| | | |
|---|---|---|
| JP | 34-6678 | 8/1959 |
| JP | 44-13638 | 6/1969 |
| JP | 58-180160 | 10/1983 |
| JP | 2-130245 | 10/1990 |
| JP | 10-243981 | 9/1998 |
| JP | 11-104202 | 4/1999 |
| JP | 2003-70859 | 3/2003 |
| JP | 2003-180774 | * 7/2003 |

* cited by examiner

*Primary Examiner*—Steven O. Douglas
(74) *Attorney, Agent, or Firm*—Westerman, Hattori, Daniels & Adrian, LLP.

(57) ABSTRACT

The arm and hand can be reliably massaged with a massaging machine having a chair body 5 having a seat 2 and a backrest 3; an armrest 7 provided to the side of the seat 2; a tunnel-shaped support 22 provided to stand from the armrest 7 so as to enable the massagee's arm or hand placed on the armrest 7 to be inserted therein; and expanding/contracting massage air cells 34, 35 provided to the inner surface of the tunnel-shaped support 22.

19 Claims, 20 Drawing Sheets

MASSAGE MACHINE, MASSAGER FOR HANDS AND MASSAGING METHOD

TECHNICAL FIELD

The present invention relates to a massaging machine, arm and hand massager and massaging method.

BACKGROUND ART

There is a pneumatic massaging machine comprising an air cell which expands/contracts according to the supply of air. The air cell is generally disposed at the backrest, seat or leg rest of the chair.

Japanese Patent Publication No. S44-13638 describes a massaging machine in which a bellows-shaped expandable cylinder, which expands and contracts according to air, is disposed at the upper part of the armrest. Here, the massagee' arm will be pressed upward.

DISCLOSURE OF THE INVENTION

Since the arm is lighter than the body, when the arm is pressed upward from the armrest, there are cases when the arm slips upward and a sufficient massage feeling cannot be obtained. Thus, an object of the present invention is to reliably massage the arm or hand.

The present invention is a massaging machine, comprising: a chair body having a seat and a backrest; an armrest provided to the side of the seat; a tunnel-shaped support provided to stand from the armrest so as to enable the massagee's armor hand placed on the armrest to be inserted therein; and a massage air cell provided to the inner surface of the tunnel-shaped support which expands/contracts according to the supply/discharge of air. Since a tunnel-shaped support is provided to the armrest, the arm or hand can be easily inserted inside the tunnel-shaped support. And, since the air cell provided to the inner surface of the tunnel-shaped support massages the arm or hand inserted inside the tunnel-shaped support, it is possible to prevent the arm or hand from slipping, and the arm or hand can be reliably massaged thereby.

Here, "arm or hand" (upper limb) refers to the overall anterior portion of the arm from the shoulder forward of the body, and is a portion constituted from the upper arm, forearm, and hand. Incidentally, the hand can be divided into wrist, metacarpus, and fingers.

It is preferable that the tunnel-shaped support is open at both ends of the cross direction thereof, and the armor hand can be inserted into the rear opening, and the fingertips can come out from the front opening. Here, since the fingertips can be placed outside from the front of the tunnel-shaped support, the fingertips will be free and the feeling of being retrained can be reduced.

It is preferable that the massage air cell is capable of pressing the arm or hand against the armrest by expanding. As a result of massaging the arm or hand by pressing it against the armrest from the inner face of the tunnel-shaped support, it is possible to prevent the arm or hand from slipping, and the arm or hand can be reliably massaged thereby with a simple constitution.

It is preferable that the armrest is provided with an acupressure element for performing acupressure to the arm or hand being pressed with the massage air cell. As a result of performing acupressure with the pressing strength of the air cell, acupressure can be effectively performed to the arm or hand.

It is preferable that the armrest is provided with a vibration generator for performing vibration massage to the arm or hand being pressed with the massage air cell. As a result of vibration being generated when the arm or hand is pressed with the air cell, vibration is effectively conveyed to the arm or hand, and the effect of the vibration massage can be improved thereby.

It is preferable that the tunnel-shaped support has a tunnel-shaped external member, and an internal member provided inside the external member while retaining space between the external member; the massage air cell is installed to the internal member; and the space between the external member and the internal member is pipe space for installing a pipe for supplying air to the massage air cell. Here, the space for passing a pipe to the air cell can be secured within the tunnel-shaped support.

It is preferable that the tunnel-shaped support is provided movably forward and backward.

The tunnel-shaped support may be relatively displaced in relation to the armrest, or the armrest provided with the tunnel-shaped support may be relatively displaced in relation to the seat.

More specifically, it is preferable that the armrest moves backward in conjunction with the motion of the backrest reclining backward, and moves forward in conjunction with the motion of the backrest rising forward; and the tunnel-shaped support moves forward and backward according to the forward and backward movement of the armrest. Since the position of the arm or hand will be in the rear when the backrest is reclined backward, as a result of moving the armrest forward and backward in conjunction with the reclining motion of the backrest, the massaging position can be maintained approximately constant regardless of the reclining motion of the backrest.

It is preferable that the massage air cell is disposed so as to press the palm or back of the hand placed on the armrest.

Further, it is preferable that the length of the cross direction of the tunnel-shaped support is set to an extent such that only the anterior portion of the massagee's wrist is positioned therein; and the massage air cell is used for massaging the palm or back of the hand.

The present invention viewed from another perspective is a chair-type massaging machine having an armrest comprising an air cell at the upper side of the armrest which expands/contracts according to the supply/discharge of air, wherein the air cell is provided so as to press the massagee's arm or hand placed on the armrest against the armrest by expanding downward. As a result of the air cell expanding downward toward the armrest and pressing the arm against the armrest, it is possible to pressure the arm or hand with the air cell while preventing the arm or hand from slipping with the armrest.

The present invention pertaining to an arm and hand massager is an arm and hand massager to be used upon being mounted on the armrest of a chair, comprising: a tunnel-shaped support mounted on the armrest so as to enable the massagee's arm or hand placed on the armrest to be inserted therein; and an air cell provided to the inner surface of the tunnel-shaped support for massaging the arm or hand by expanding/contracting. When this arm and hand massager is used, the air cell provided to the tunnel-shaped support will reliably massage the arm or hand while preventing the arm or hand from slipping.

The present invention pertaining to a massaging method is a massaging method, comprising pressing the massagee's arm or hand placed on an armrest of a chair-type massaging machine having such armrest against the armrest with an air cell which expends/contracts according to the supply/discharge of air. According to this method, it is possible to prevent the arm or hand from slipping since the arm or hand is pressed against the armrest.

List of Elements massaging machine seat

3 backrest

4 leg rest

5 chair body

7 armrest

Figure 1:
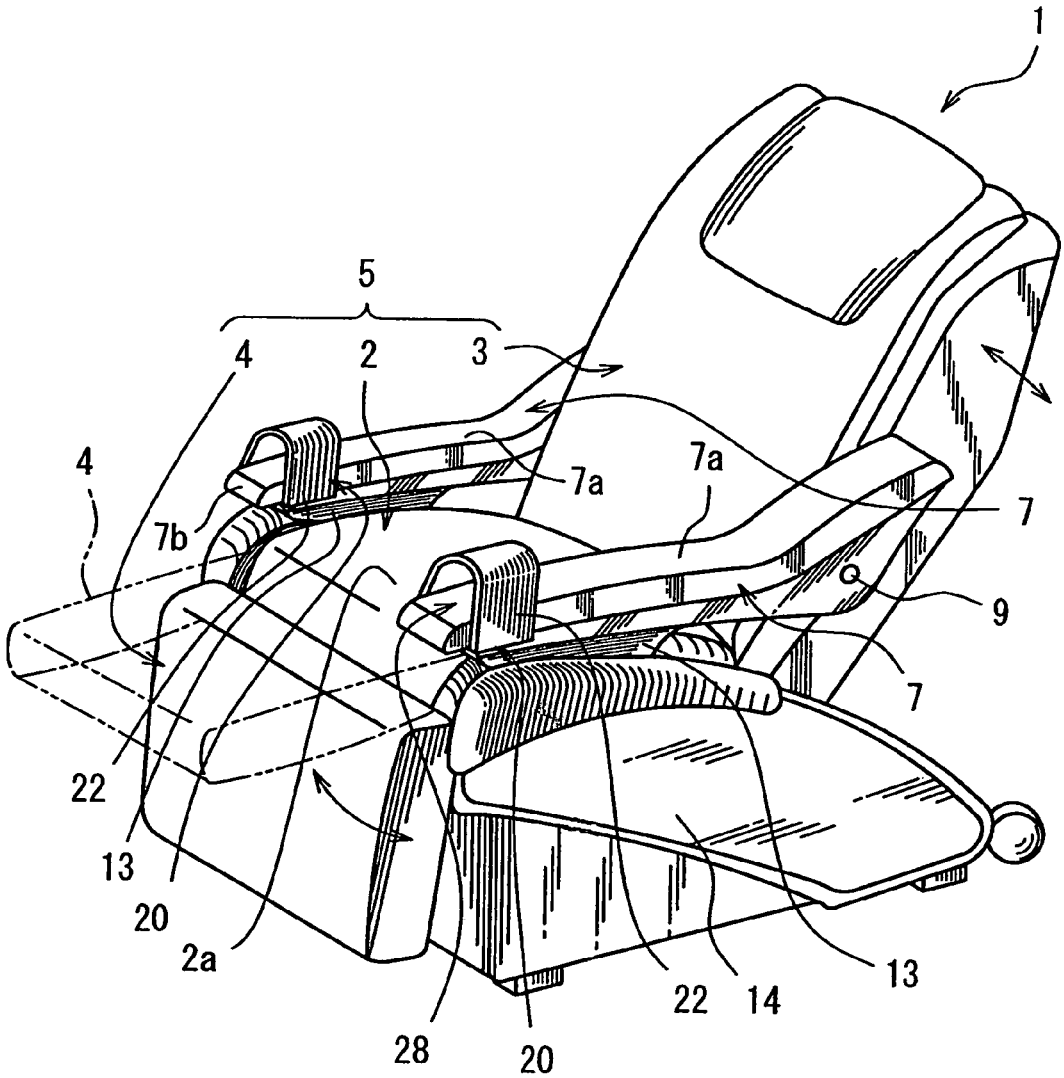
FIG. 1 is a perspective view of the chair-type massaging machine.

7*a* upper face of the armrest (surface on which a palm is placed)

20 arm and hand massager

22 tunnel-shaped support

27 rear opening

28 front opening

30 external member (external shell)

31 internal member (internal shell)

33 upper air cell

34 left air cell

35 right air cell

39 air pipe

41 pipe space

46 air supply/discharge device

48 vibration generator

49 acupressure element

BEST MODE FOR CARRYING OUT THE INVENTION

Embodiments of the present invention are now explained with reference to the drawings.

FIG. 1 shows a chair-type massaging machine 1. This chair-type massaging machine 1 has a chair body 5 including a seat 2, a backrest 3 disposed at the back of the seat 2, and a leg rest 4 disposed at the front of the seat.

With the seat 2, the upper face (seat surface) 2*a* thereof is an inclined face with the front part facing upward such that the foremost part is the highest, and the massagee is able to sit back in the chair.

Figure 2:
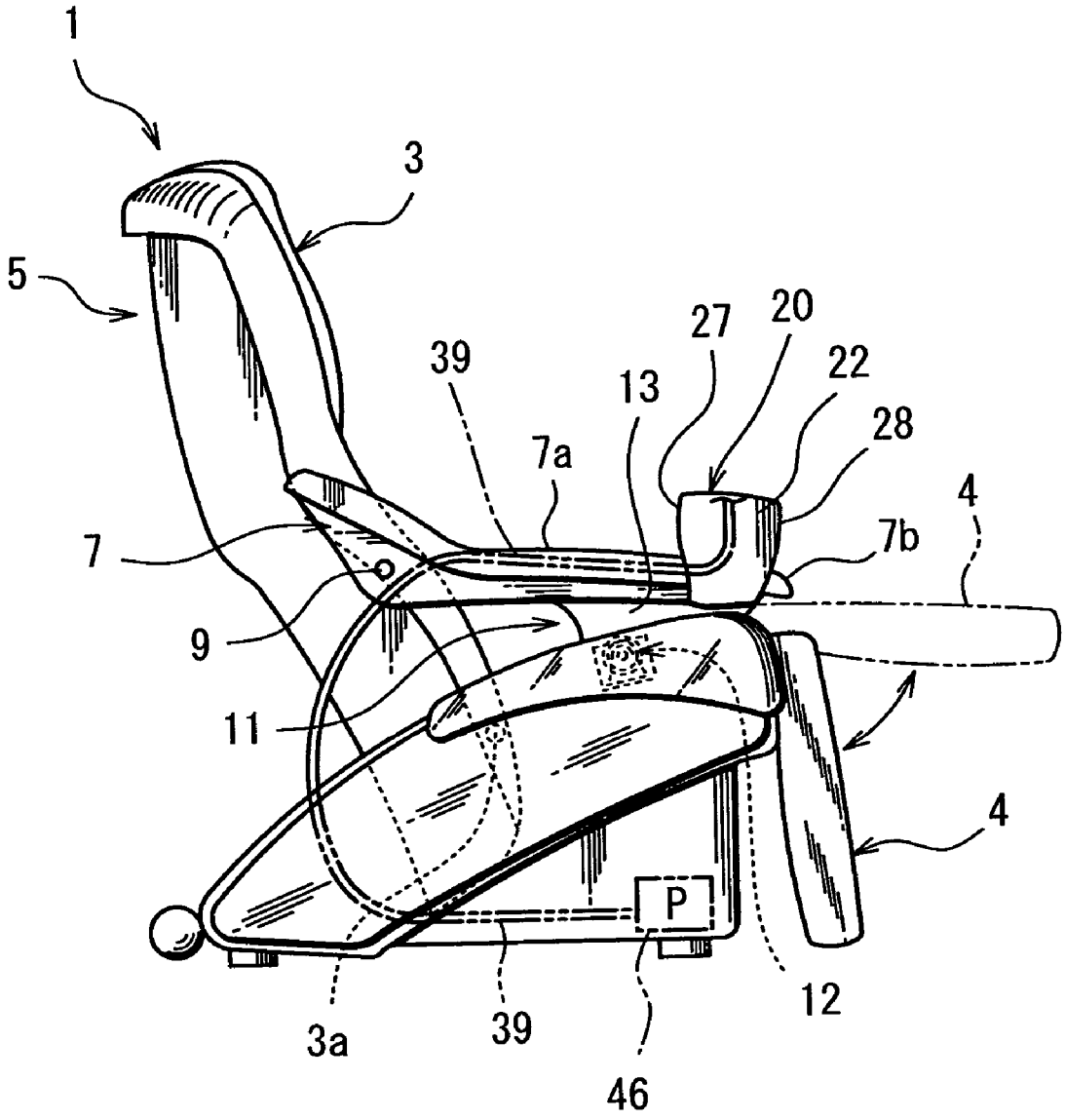
FIG. 2 is a side view of the chair-type massaging machine.

The backrest 3, with the lower position thereof as the center of rotation 3*a*, is constituted to be reclinable, and can be reclined backward from the position shown in FIG. 1, and can be returned from the reclined state to the position shown in FIG. 1 by being pulled upward. Reclining is conducted with a reclining drive unit not shown such as an electric motor or fluid cylinder. Incidentally, the backrest 3 is slightly inclined backward at a position of being fully pulled upward as depicted in FIG. 2.

The leg rest 4 is constituted to be rotatable upward and downward, and can be raised to an approximately horizontal position illustrated with the dotted line in FIG. 1 by being rotated forward from the downward position shown with the solid line in FIG. 1, and can be returned to the downward position by being rotated backward from the raised state. The rotation of the leg rest 4 is also conducted with a drive unit not shown such as an electric motor or fluid cylinder.

When the backrest 3 is reclined backward and the leg rest 4 is raised, the area from the backrest 3 to the leg rest 4 will become approximately flat, and the massagee will take a recumbent position. A massager (not shown) is disposed to the seat 2, backrest 3 and leg rest 4 respectively or entirely, and a massage can be performed to the massagee in a sitting position or recumbent position. Various items may be employed as the massager, such as a massaging ball driven with a motor or an air cell which expands/contracts according to the supply/discharge of air.

Armrests 7, 7 are disposed to both the left and right sides of the seat 2, and the massagee can place his/her arms or hands on the armrests 7, 7 and relax. The rear parts of the armrests 7 are mounted on the left and right sides of the backrest 3, and the armrests 7 are provided extending forward at the left and right side positions of the seat 2. The rear part of the armrest 7 is pivotally attached to the backrest frame (not shown) constituting the framework as the backrest inside the backrest 3, and is freely rotatable around an axis 9 in the horizontal direction. In other words, the rear part of the armrest 7 is the rotational base. Meanwhile, the front part of the armrest 7 is not mounted to any other part, and is a freely rotatable end.

Figure 3:
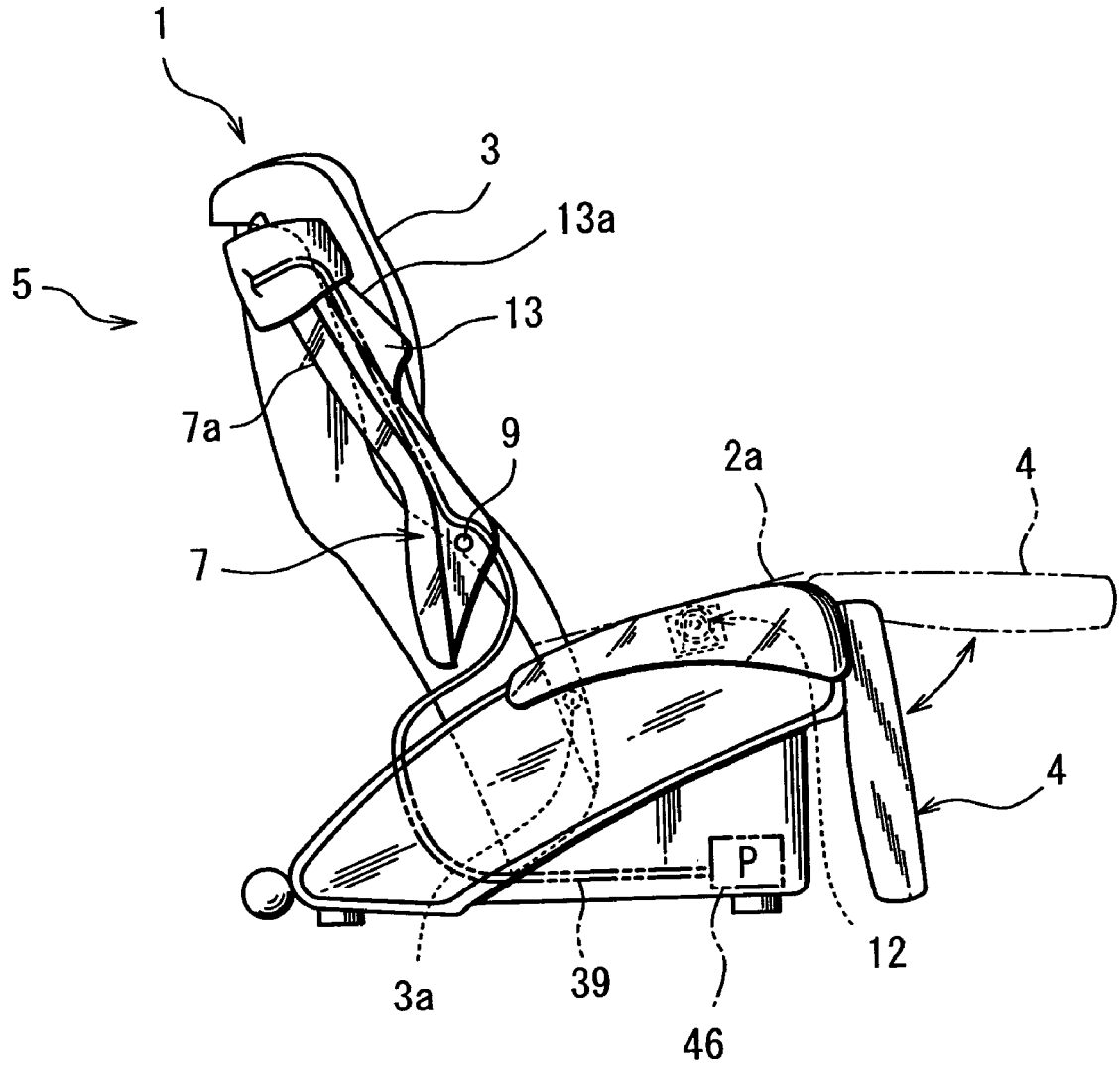
FIG. 3 is a side view of the chair-type massaging machine in a state where the armrest is rotated upward.

Therefore, the armrest 7 is able to rotate around the rotational base (axis 9), and is able to take on the position of the front part thereof facing approximately forward as shown in FIG. 1 and FIG. 2, or take on a raised position of the front part thereof facing upward by being rotated backward as shown in FIG. 3. Incidentally, the left and right armrests 7, 7 may be rotated independently, or the armrests 7, 7 may be rotated integrally. Moreover, only one armrest 7 may be rotated.

The range of the backward rotation of the armrest 7 around the rotational base (axis 9) is restricted from the state (=first position) in which the armrest 7 is positioned at the side of the seat 2 as shown in FIG. 1 and FIG. 2, to a state (=second position) in which the armrest 7 is positioned at the side of the (raised) backrest 3 as shown in FIG. 3.

The first position is the normal position of using the armrest 7. The massagee is able to place his/her arm or hand on the armrest 7 at the first position. Meanwhile, when the armrest 7 is in the way, or when the massagee wishes to sit or stand from the side of the seat 2 (the motion of sitting or standing from the side of the seat is hereinafter referred to as the "sideward sitting/standing motion"), as shown in FIG. 3, as a result of rotating the armrest 7 to the second position, the armrest 7 will not exist at the side of the seat 2 in a state where it will not be in the way of the sideward sitting/standing motion. Therefore, the massagee can easily make the sideward sitting/standing motion.

Figure 4:
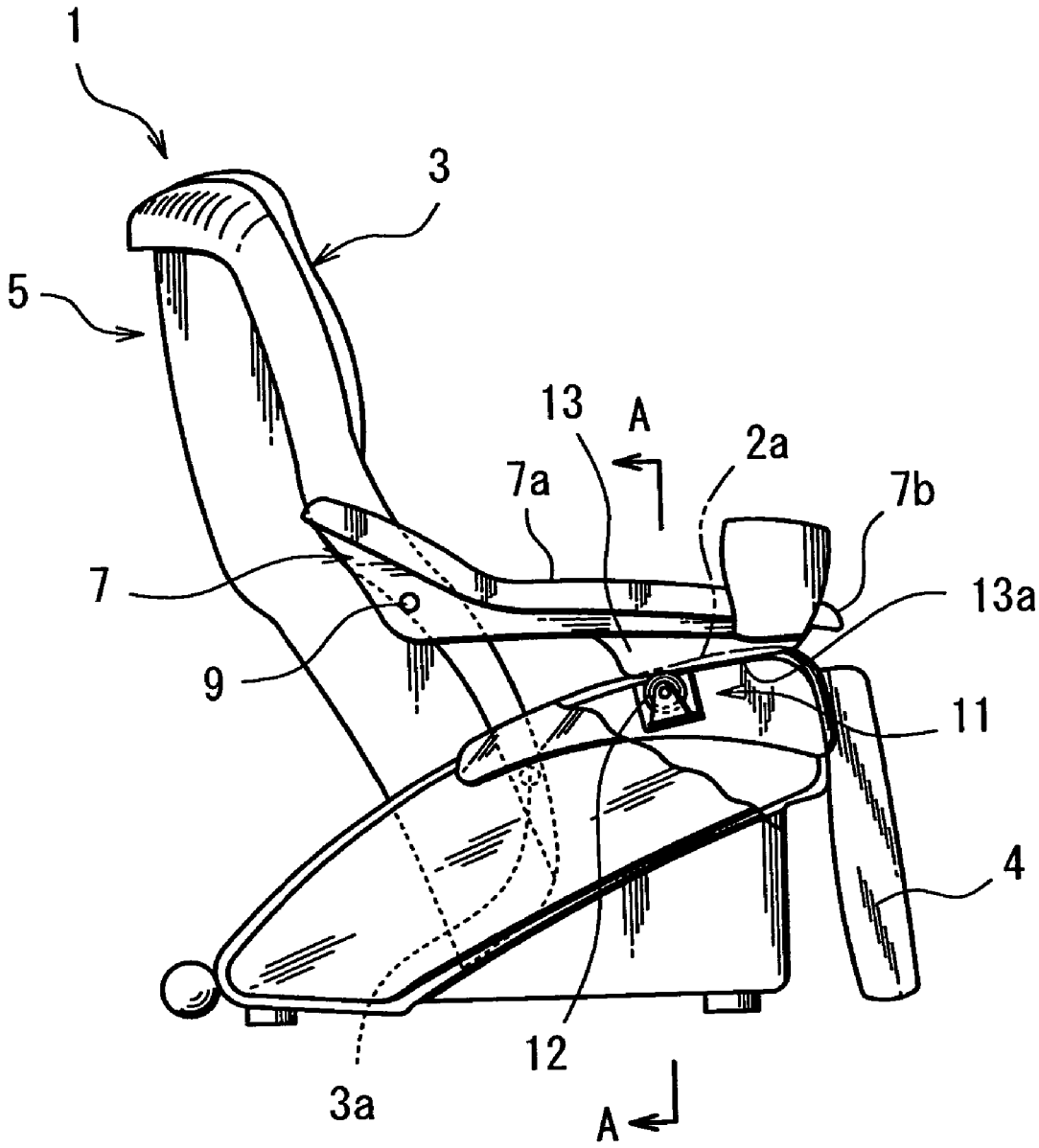
FIG. 4 is a side view showing the guide mechanism.
Figure 5:
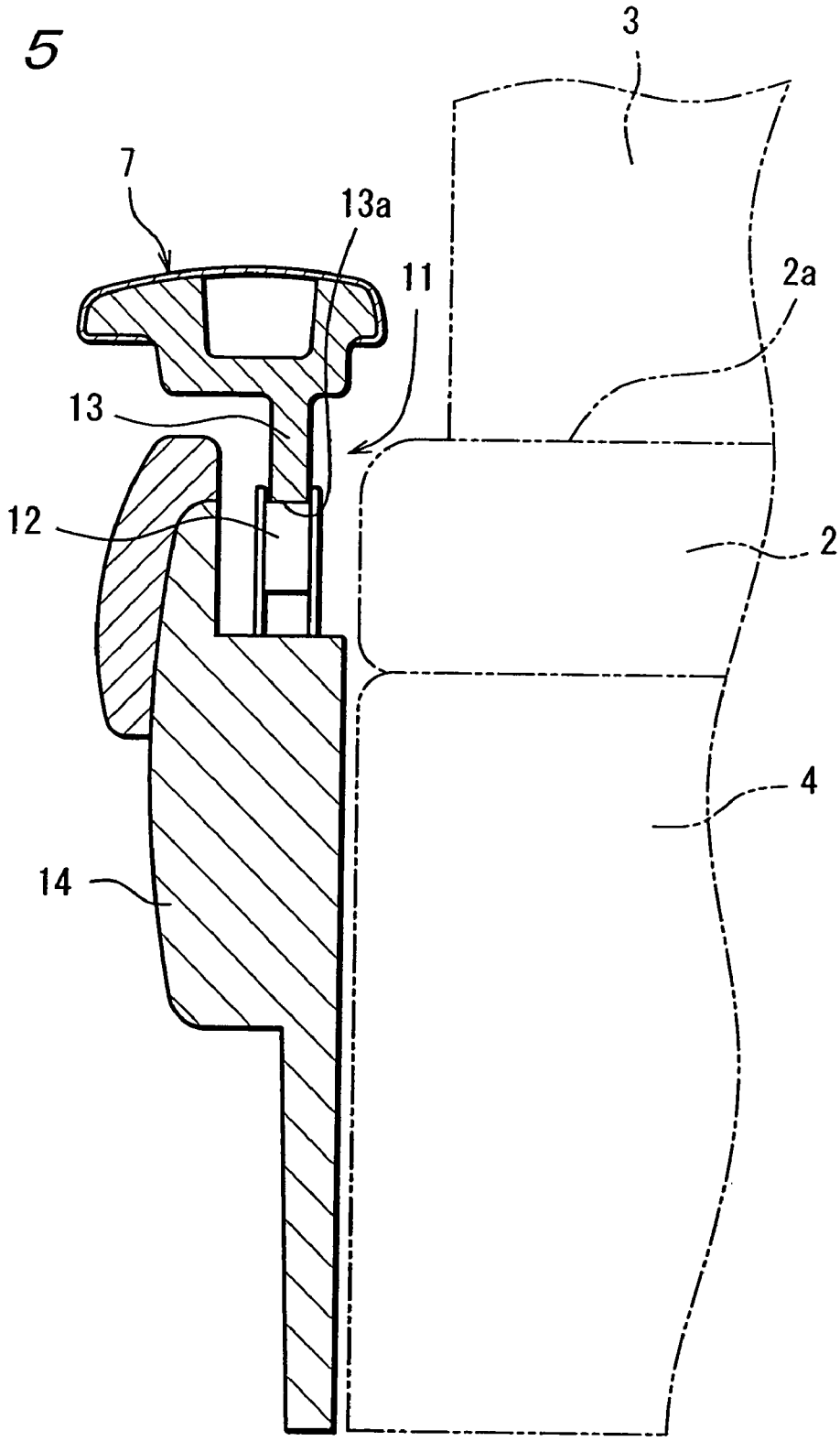
FIG. 5 is a cross section of line A-A illustrated in FIG. 4.

As shown in FIG. 4 and FIG. 5, the front part of the armrest 7, which is a free end, is supported with a guide mechanism 11, and this guide mechanism 11 guides the movement of the armrest 7 in conjunction with the reclining of the backrest 3.

The guide mechanism 11 is constituted by having a guide body provided to the side of the seat 2, and a guide unit 13 provided to the armrest 7 so as to be guided by the guide body. Incidentally, since the armrest 7 is provided such that the front part thereof is able to rotate downward with its self weight, unless the armrest 7 is raised against its self weight, the contact between the guide body and guide unit 13 will be maintained naturally. Moreover, in place of, or in addition to, the front part of the armrest rotating downward with its self weight, it may be biased to rotate downward with a biasing tool such as a spring.

The guide body is disposed at the upper part of the side cover 14 provided to the position at the left and right sides of the seat 2, and is constituted from a roller 12 provided to a position that is lower than the upper face 2*a* of the seat. The roller 12 is mounted on the seat frame (not shown) for supporting the seat 2, and is covered with the side cover 14 such that only the upper part of the roller is exposed upward. The roller 12 is freely rotatable around the center of horizontal axle.

The guide unit 13 is provided at the lower part of the armrest 7, and has a contact guide face 13*a* which contacts the roller 12. In the state shown in FIG. 4 and 5, the self weight of the armrest 7 is making the contact guide face 13*a* contact the roller 12. As a result of the contact guide face 13*a* contacting the roller 12, the armrest 7 is restricted from rotating downward any further than the first position (state shown in FIG. 4 and FIG. 5). In other words, the roller 12 is supporting the armrest 7 from below.

Figure 6:
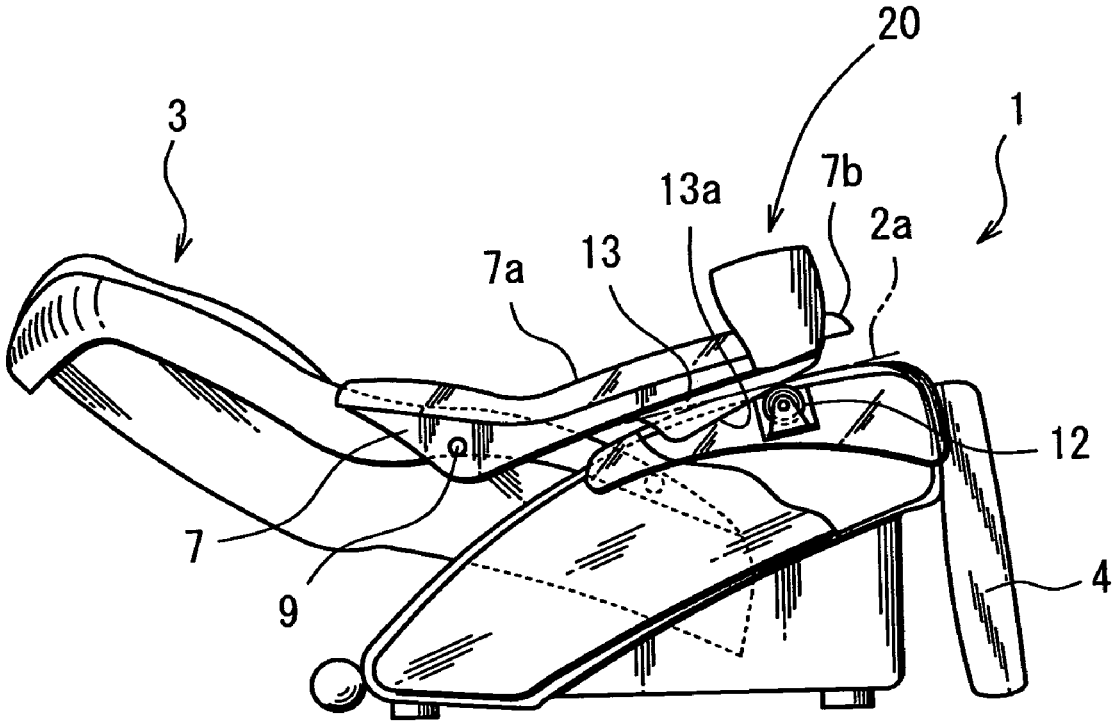
FIG. 6 is a side view of the chair-type massaging machine in a state where the backrest is reclined backward.
Figure 7:
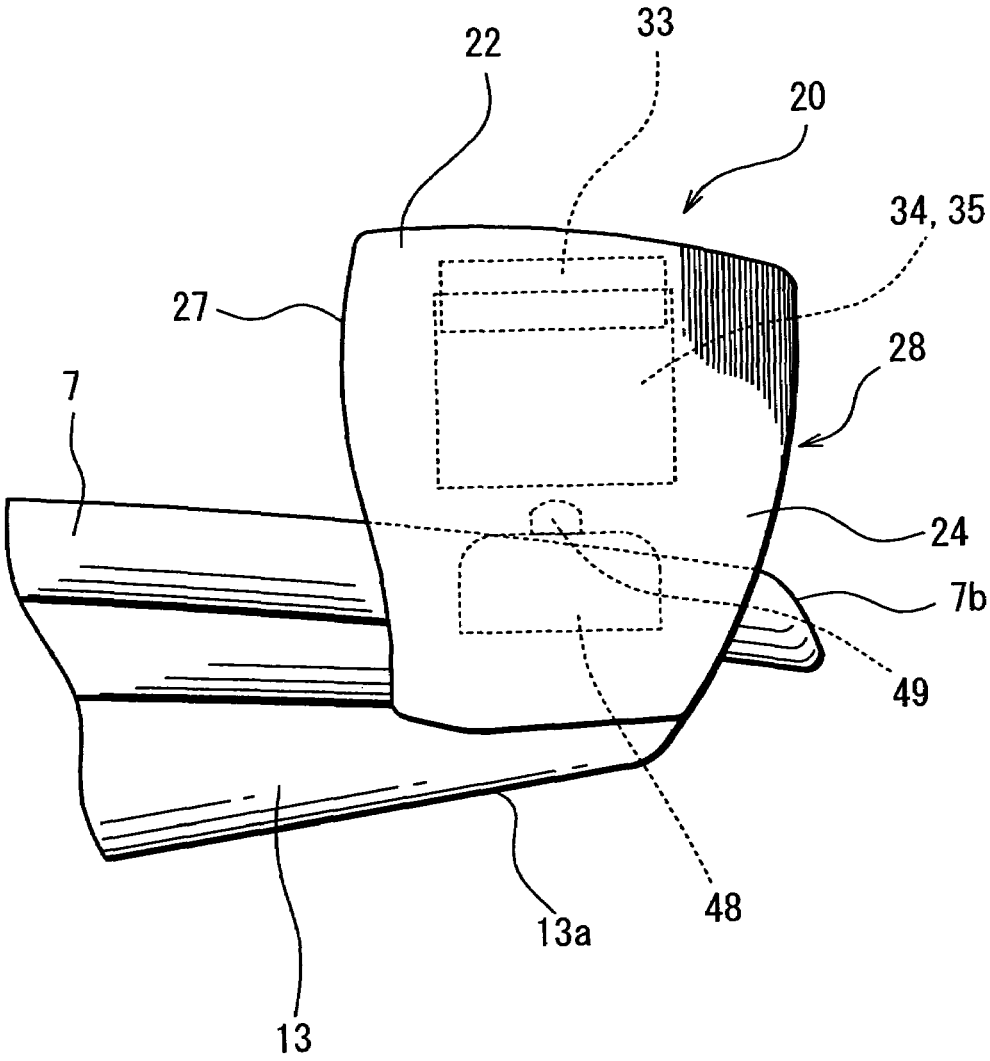
FIG. 7 is a side view of the arm and hand massager.
Figure 8:
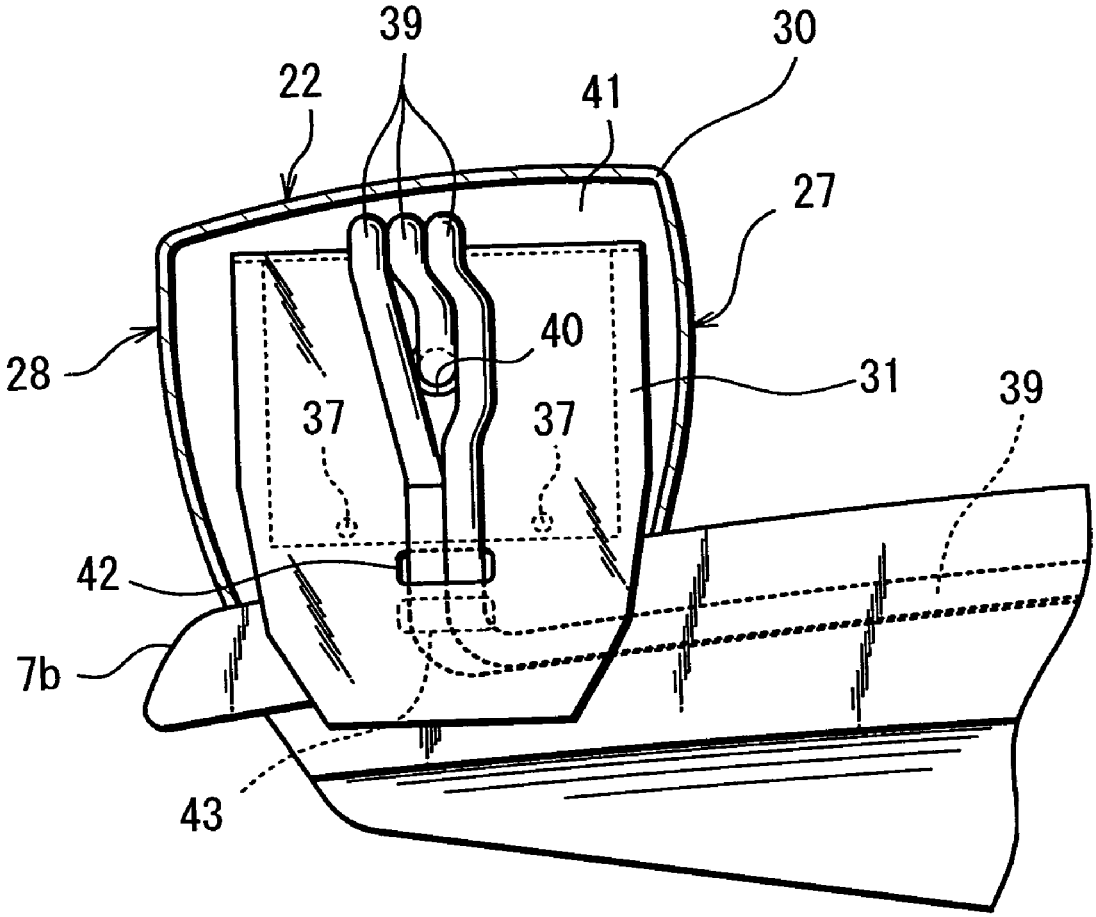
FIG. 8 is a diagram showing the inside of the arm and hand massager.

As shown in FIG. 6, when the backrest 3 is reclined backward, the armrest 7 mounted to the backrest 3 via the axis 9 will move backward by being pulled back by the backrest 3 while the front part thereof still faces forward. Here, the armrest 7 if freely rotatable in relation to the backrest 3, and, since the front part of the armrest 7 is only supported with the roller 12 freely forward and backward, the backward movement of the armrest 7 is not hindered.

Further, since the position of the axis 9 moves downward as a result of the backrest 3 being reclined, the overall armrest 7 (in particular the rear side thereof) will also move downward.

When the armrest 7 is not freely rotatable in relation to the backrest 3, since the angle of the armrest 7 against the backrest 3 will be maintained, if the backrest 3 is reclined backward, the armrest 7 will become significantly upward, and it will be difficult to place the arm or hand on the armrest 7. Contrarily, in the present embodiment, since the armrest 7 is freely rotatable in relation to the backrest 3, when the backrest 3 is reclined backward, the angle of the armrest 7 against the backrest 3 will open, and the state of the front part of the armrest 7 facing forward will be maintained.

With the guide unit 13, the rear side thereof is vertically thick, and the front side thereof is vertically thin, and the contact guide face 13*a* is inclined upward in the forward direction. Thus, when the armrest 7 moves backward and the front part of the contact guide face 13*a* contacts the roller 12, the front part of the armrest 7 is lowered slightly, and the massagee is able to place his/her arm or hand in a recumbent position.

The upper face 7*a* of the armrest 7 is constantly positioned more upward than the upper face 2*a* of the seat in the entire range of the forward and backward movement. Thus, the massagee is able to place his/her arm or hand in an appropriate state whether in a sitting state or a recumbent state.

Further, when the backrest 3 is reclined backward, the armrest 7 will be slightly upward than the horizontal state, and the massagee in a recumbent state will be able to easily place his/her hand on the armrest 7.

Incidentally, a roller as the guide unit 13 may be provided to the armrest 7, and a contact guide face (face the roller will roll over) as the guide body may be provided to the side of the seat 2.

FIG. 7 to FIG. 12 show an arm and hand massager 20 provided respectively to the left and right armrests 7. Incidentally, the arm and hand massager 20 may be provided to only one armrest 7.

This massager 20 is suitable for massaging the anterior portion (hand) that is forward of the wrist, and, in particular, is suitable for massaging the anterior portion (metacarpus) that is forward of the wrist excluding the fingers, and has a tunnel-shaped support 22 which enables the arm or hand placed on the armrest 7 to be inserted therein. Incidentally, the massager 20 may be used to massage the portion (upper arm or forearm) closer to the shoulder side than the wrist.

The tunnel-shaped support 22 has a side face portion 24 positioned at both sides in the width direction of the armrest 7 and extending upward of the armrest 7, and an upper face portion 25 for connecting the left and right side face portions 24, 24 at the upper part of the armrest 7. The upper face part 25 of the support is disposed at a height in which the arm or hand can be inserted in the space with the upper face 7*a* of the armrest. Further, the interval between the left and right side face portions 24 is set to enable an arm or hand to be inserted therebetween. Here, the side face portion 24 and the upper face portion 25 are formed in a continuous arc shape, and the overall support 22 is of an arc shape. Although the boundary of the side face portion 24 and the upper face portion 25 is unclear, the shape may be such that the boundary is evident.

The support 22 is opened at both ends 27, 28 thereof in the cross direction (lengthwise direction of the armrest 7), and the opening 27 at the rear side enables the arm or hand to be inserted into the support 22, and the opening 28 at the front side enables the inserted arm or hand (fingertip) to come out therefrom. With the support 22, the metacarpus (back of the hand and palm) is positioned therein, and the portion on the shoulder side behind the wrist and the fingertip are set to a position outside the support 22 in the cross direction length, and is a suitable size for massaging the back of the hand or palm. Moreover, the support 22 is mounted on a position where the back of the hand or palm will be when the arm or hand is placed on the armrest 7; in other words, on the front part of the armrest 7.

The support 22 is positioned slightly backward of the front end of the armrest 7, and the fingertip put out from the front opening 28 of the support 22 can be placed on the upper face 7*a* of the armrest. Further, joints of the fingers placed outside from the front opening 28 can be bent inside. In other words, the front end of the upper face 7*a* of the armrest 7 is a downward inclined face 7*b* inclining downward, and, by placing the fingers on the downward inclined face, the fingers can be bent and the palm or back of the hand can be massaged in a relaxed state.

Moreover, even if the downward inclined face 7*b* is not provided to the front end of the armrest 7, fingers can be bent so as long as the support 22 is positioned such that the root of the fingers can be placed and the fingertip can be positioned forward of the front end of the armrest 7 when the palm or back of the hand is positioned inside the support 22 and when the fingers are placed outside from the front opening 28.

In either case, as a result of the support 22 being provided at a position where the fingers can be bent, the arm or hand can be massaged in a relaxed state.

The support 22 has an internal and external dual structure of a combination of an external member 30 positioned externally and an internal member 31 positioned more internally than the external member 30.

The external member 30 is formed from a hard material such as resin or metal. Further, the external member 30 is formed in an arc shape, and has a function as a decorative cover since it is a member positioned at the uppermost surface of the massager 20. Moreover, the external member 30 has a function as amounting member for mounting the overall massager 20 on the armrest 7, and the lower parts 30*a*, 30*b* of the external member 30 are provided extending inside toward the lower part of the armrest 7, and these lower parts 30*a*, 30*b* are fixed to the armrest 7 with a fixing tool (not shown) such as a screw.

The internal member 31 is formed from a hard material such as resin or metal, and is disposed to form a space between the external member 30, and both lower ends thereof are mounted to the inner face of the external member 30. Air cells 33, 34, 35 for pressuring the arm or hand by expanding/contracting according to the supply/discharge of air are provided to the inner face of the arc-shaped internal member 31. As the air cells, provided are a first air cell (upper air cell) 33 mounted on the vicinity of the top of the internal member 31, and second air cells (side air cells) 34, 35 are mounted on the vicinity of the left and right side faces of the internal member 31.

Since the support 22 is formed from a hard material, in addition to being able to reliably retain the air cell, space for inserting the arm or hand can be maintained.

The air cells 33, 34, 35 are formed by taking a thin fabric sheet material formed from a material such as synthetic resin and forming a bag shape. The air cell expands by an air supply/discharge device supplying air thereinto. Further, when air is discharged from the air cell, the air cell will contract and become a flat state.

Figure 10:
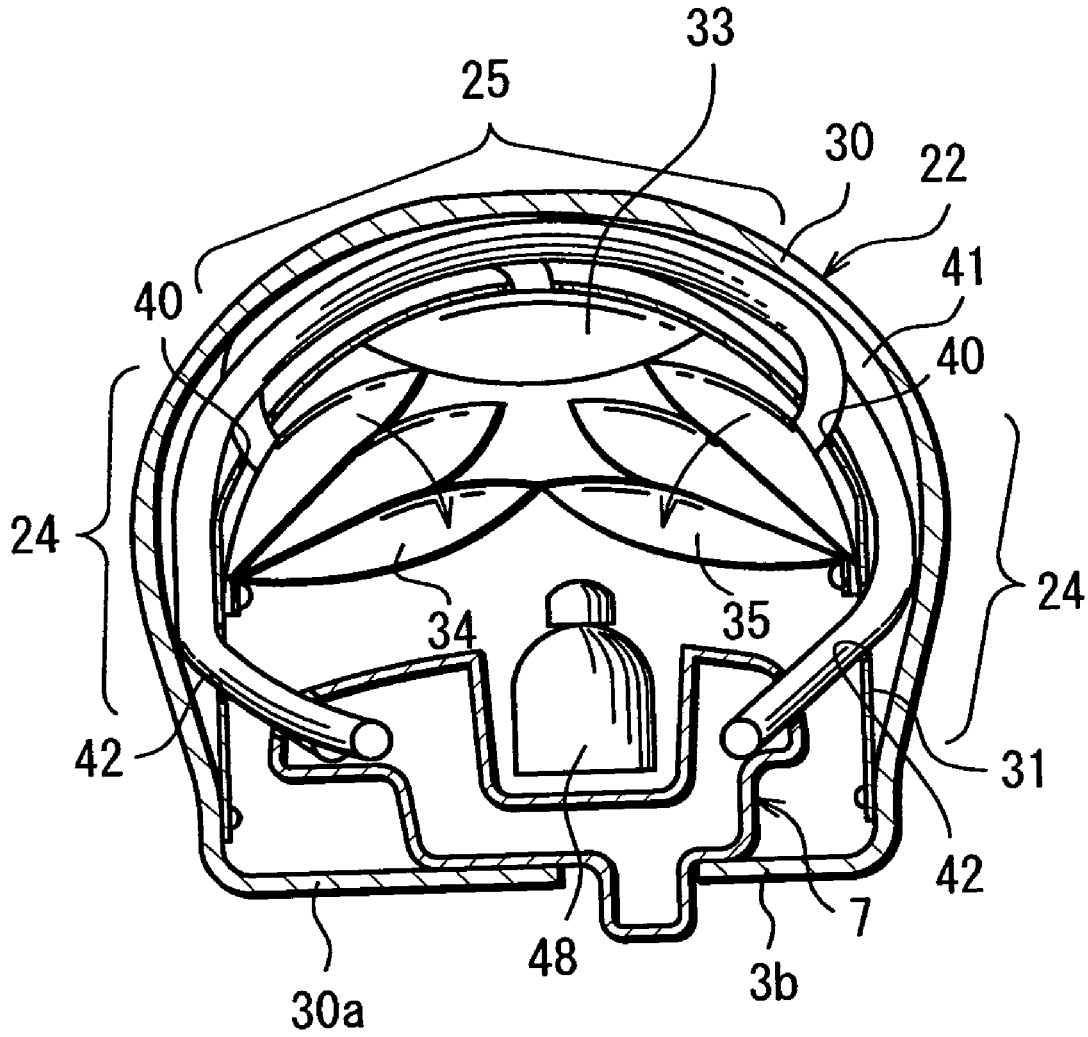
FIG. 10 is a cross section of the arm and hand massager in a state where the air cell expands.

As shown in FIG. 10, the first air cell 33 is provided to expand downward, and is capable of pressing the arm or hand downward. The second air cells 34, 35 are disposed to partially overlap with the first air cell 33, and the lower parts thereof are respectively mounted on the internal member 31 with a fixture (screw, pin or the like). The upper parts of the second air cells 34, 35 are not mounted on the internal member 31, and are freely expandable ends. Thus, the upper part of the second air cells 34, 35 expands greater then than the lower part thereof. Incidentally, the air cell side parts of the second air cells 34, 35 are formed in a cornice shape such that the amount of expansion becomes greater. The second air cells 34, 35 are able to press the arm or hand downward from the left and right sides. Moreover, as shown in FIG. 10, when the first air cell 33 and second air cells simultaneously expand, the amount of downward pressure can be increased.

Incidentally, in the following explanation, the second air cell 34 positioned at the pinky side of the arm or hand inserted inside the support 22 is referred to the external air cell, and the second air cell 35 positioned at the thumb side is referred to as the internal air cell.

Since the support 22 is mounted on the armrest 7 via the left and right side face parts 24 positioned at both sides in the width direction of the armrest 7, even if the upward reaction against the support 22 acts when the air cells 34, 35 expand downward and presses the arm or hand, the structure is suitable for enduring such reaction.

An air pipe 39 is connected to each air cell 33, 34, 35. The air pipe 39 is connected to the expanding back face (upper side; side facing the internal member 31) of the air cell, and is passed through to the space inside the support 22 (space between the external member 30 and internal member 31; pipe space) upon passing through a first through hole 40 formed in the internal member 31. Each pipe 39 is extending to the vicinity of the armrest 7 via the pipe space 41. Further, each pipe 39 is drawn out from the pipe space 41 via a second through hole 42 formed in the vicinity of the armrest 7 of the internal member 31, and is passed through to the inside of the armrest 7 via a third through hole 43 formed in the armrest 7. A pipe space 44 is formed inside the armrest 7, and each pipe 39 is extending backward via the internal space 44 of the armrest. The pipe 39 provided extending near the rotational axis 9 of the armrest comes out of the armrest 7 in the vicinity of such axis 9. As a result of placing the pipe 39 outside the armrest 7 in the vicinity of the rotational axis 9, the displacement of the pipe according to the rotation of the armrest can be decreased.

The pipe 39 placed outside the armrest 7 is drawn around the lower part of the backrest 3 from the side face of the backrest 3, and connected to the air supply/discharge device 46 disposed below the seat 2. Incidentally, in order to guide the pipe 39 below the seat, the pipe 39 may be passed through from the vicinity of the rotational axis 9 of the armrest 7 inside the backrest 3, and extended to the lower part of the seat 2 from inside the backrest 3.

Connected to the air supply/discharge device 46 is a pipe (not shown) connected to the massage air cell (not shown) provided to the seat 2, backrest 3 or leg rest 4 of the chair body 5, and the air cell expands/contracts by performing the supply/discharge of air to the respective air cells. Further, the air supply/discharge device 46 is controlled with a control device (not shown), and such control device is capable of controlling the method of expanding and contracting the respective air cells.

Figure 9:
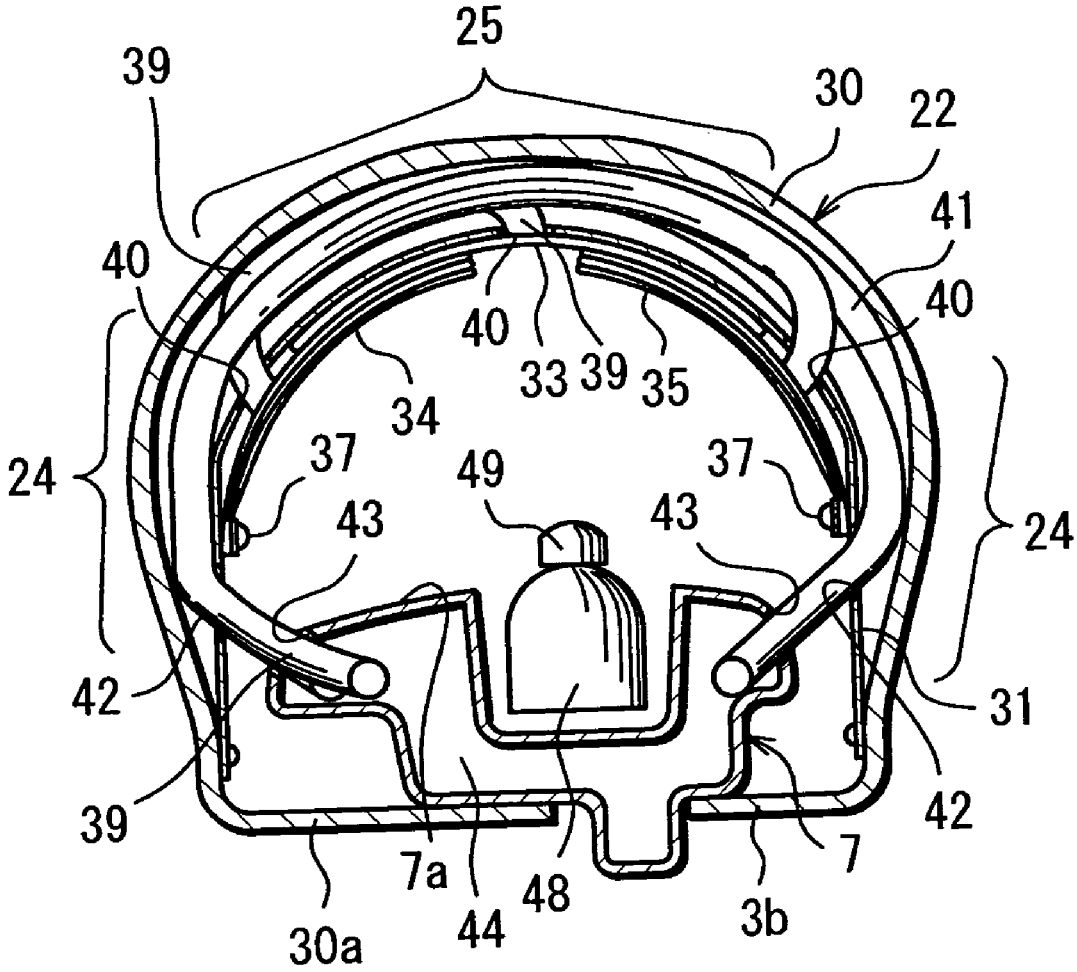
FIG. 9 is a cross section of the arm and hand massager.

Among the upper faces 7*a* of the armrest, a vibration generator 48 for performing a vibration massage to the arm or hand is provided to the range of the bottom of the tunnel formed with the support 22. The upper face 7*a* of the armrest is formed in a concave shape, and the vibration generator 48 is embedded inside the armrest. The vibration generator 48 has an acupressure element 49 protruding in relation to the upper face 7*a* of the armrest, and vibration is locally conveyed to the arm or hand inserted inside the support 22 via this acupressure element 49. As shown in FIG. 9, the acupressure element 49 is disposed biased in the horizontal direction in relation to the center position in the horizontal width direction of the armrest 7. Specifically, the acupressure element 49 is disposed biased to a position closer to the seat 2 (right side if the armrest 7 is for the left arm; and left side if the armrest 7 is for the right arm) in relation to the center position in the horizontal width direction of the armrest 7. As a result of the acupressure element 49 being positioned biased closer to the seat 2 in relation to the center position, the "pressure point" (Rokyu), which is the acupuncture point in the palm, and the vicinity thereof (area near the thumb of the palm) can be subject to acupressure reliably.

Incidentally, when vibration is to be provided evenly to a wide area of the arm or hand, it is not necessary to provide the acupressure element 49. Further, the acupressure element 49 is able to perform acupressure to the arm or hand even when the vibration is not being generated.

Figure 11:
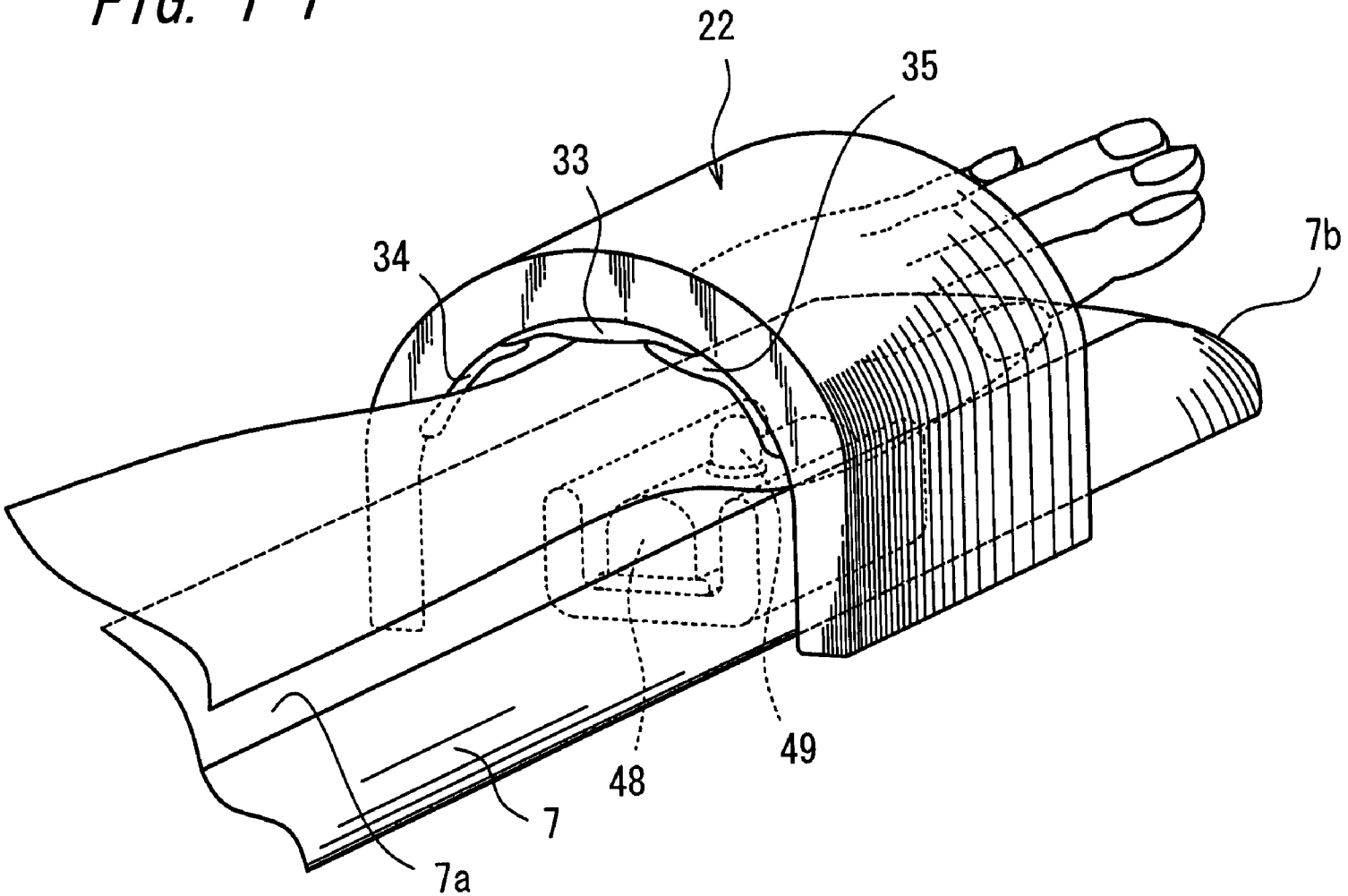
FIG. 11 is a perspective view showing a state where the arm and hand massager is being used (contraction of air cell)
Figure 12:
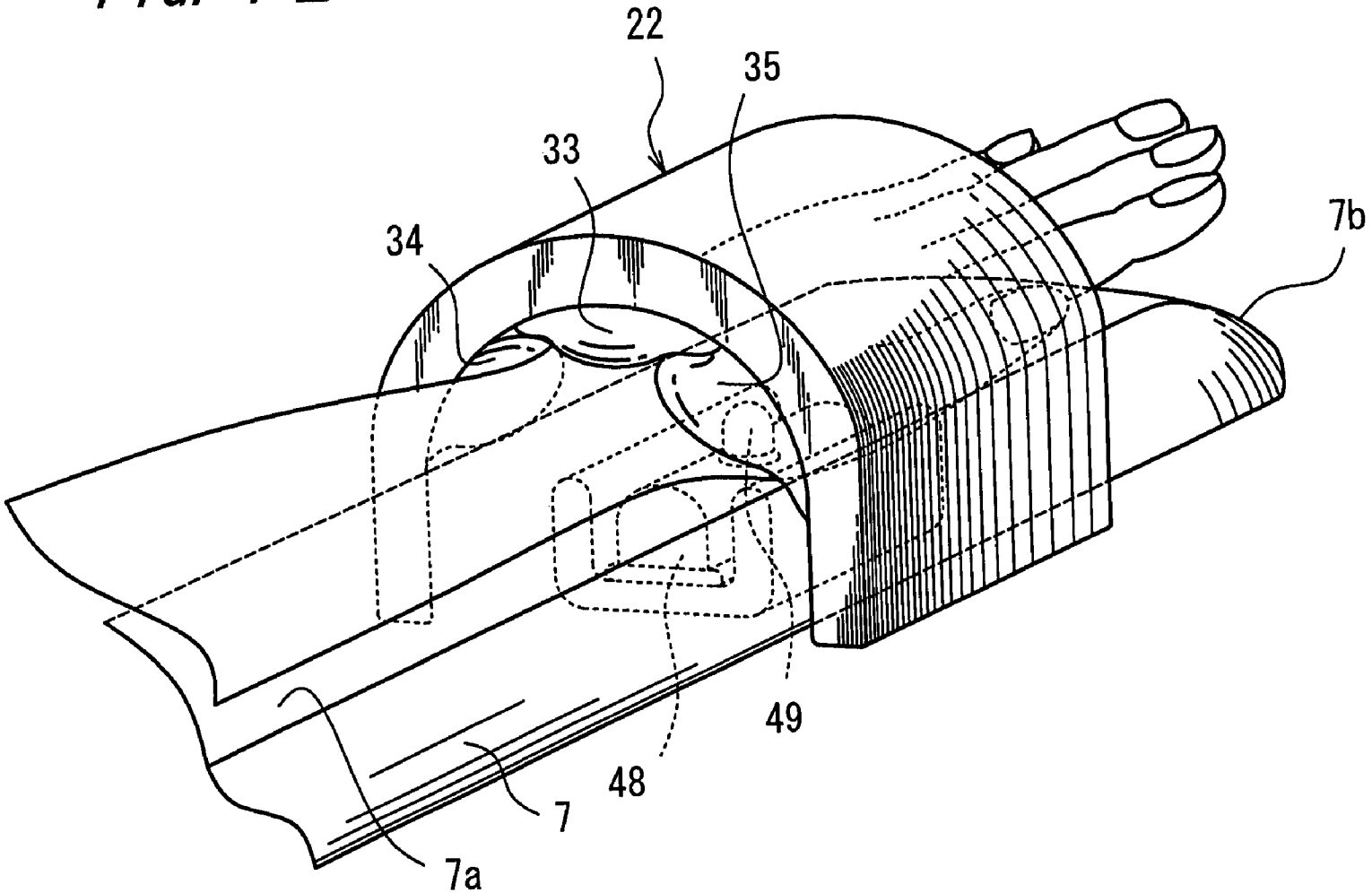
FIG. 12 is a perspective view showing a state where the arm and hand massager is being used (expansion of air cell)

As shown in FIG. 11 and FIG. 12, the palm is placed downward on the upper face 7*a* of the armrest which is to become the bottom face of the tunnel formed with the support 22. As illustrated, the upper face 7*a* of the armrest is an approximately flat palm mounting face. When the air cells 33, 34, 35 provided to the internal member 31 (support 22) disposed in a prescribed spacing above the palm mounting face 7*a* expand downward (c.f. FIG. 12), the air cells 33, 34, 35 contact the back of the hand and perform acupressure massage while pressing the hand against the palm mounting face 7*a*. Since massaging is performed while pressing the hand against the mounting face 7*a*, it is possible to prevent the hand from slipping.

As a result of pressing the hand downward with the air cells 33, 34, 35, the arm or hand can be massaged by being held from the top and bottom between the air cells and the upper face 7*a* of the armrest. In other words, a vertical massage can be performed to the arm or hand being held from the top and bottom.

Since the acupressure element 49 is protrusively provided to the palm mounting face 7*a* side, when the air cells 33, 34, 35 (particularly air cell 33) press the arm or hand against the palm mounting face 7*a* from the back of the hand side, the acupressure element 49 is pressed against the palm, and effective acupressure can be performed to the palm, in particular to the "Rokyu". Moreover, when the vibration generator 48 is operated when the hand is being pressed against the palm mounting face 7*a* side, the vibration can be conveyed to the hand effectively, and the vibration massage effect can be improved thereby.

Further, the left and right second air cells 34, 35 are able to perform acupressure to both the left and right portions of the back of the hand while pressing the back of the hand against the palm mounting face 7*a* since they expand downward from the left and right sides. Moreover, since the lower parts of the left and right air cells 34, 35 expand as the expansion bases 37, 37, the air cells can expand in a state of fitting the surface of the back of the hand having a round shape.

The first air cell 33 and second air cells 34, 35 may expand/contract simultaneously, or may expand/contract separately. Further, the left and right second air cells 34, 35 may also expand/contract simultaneously, or may expand/contract separately.

Specifically, the following expansion/contraction patterns can be implemented. Incidentally, the following expansion/contraction patterns are controlled with the control unit of the massaging machine.

(Pattern 1)

(1) The first air cell 33 expands;

(2) The second air cells 34, 35 expand;

(3) The first air cell 33 contracts;

(4) The first air cell expands again;

(5) The second air cells 34, 35 contract; and (6) The first air cell 33 contracts.

In the case of pattern 1, by pressing the back of the hand downward at (1) and (2), and thereafter contracting the first air cell 33 at (3), the left and right second air cells 34, 35 will move upward. Here, the left and right second air cells 34, 35 will squeeze the arm or hand, and a massage of squeezing the arm or hand is performed. This squeeze massage is similar to the massage of placing a person's palm diagonally on the back of the other hand and rubbing the back of the other hand with such palm. As described above, according to the operation contained in pattern 1, a massage similar to manually massaging the back of the hand can be performed.

Further, if the first air cell expands again at (3), the squeezed state is released, and, by repeating (3) and (4), the squeezing motion and the release thereof can be repeated.

(Pattern 2)

(1) The first air cell 33 expands;

(2) The internal air cell 35 among the second air cells 34, 35 expands;

(3) The external air cell 34 among the second air cells 34, 35 expands;

(4) The external air cell 35 contracts; and (5) The first air cell 33 and internal air cell 34 contract.

In the case of pattern 2, as a result of pressing from the inner side (thumb side) of the back of the hand, the acupuncture point (pressure point) located at the inner side of the back of the hand can be stimulated. There are pressure points effective to the upper body at the inner side of the back of the hand, and the upper body can be treated effectively by performing this simultaneously with (in parallel with) the upper body massage (massage with the massager provided to the backrest 3). Moreover, when the massaging machine is provided with a massage course for treating the upper body, the effect of treatment to the upper body as the overall course can be improved by performing the massage to the inner side of the back of the hand while the upper body massage course is being performed.

(Pattern 3)

(1) The first air cell 33 expands;

(2) The external air cell 34 among the second air cells 34, 35 expands;

(3) The internal air cell 35 among the second air cells 34, 35 expands;

(4) The internal air cell 34 contracts; and (5) The first air cell 33 and external air cell 35 contract.

In the case of pattern 3, as a result of pressing from the outer side (pinky side) of the back of the hand, the acupuncture point (pressure point) located at the outer side of the back of the hand can be stimulated. There are pressure points effective to the lower body at the outer side of the back of the hand, and the lower body can be treated effectively by performing this simultaneously with (in parallel with) the lower body massage (massage with the massager provided to the seat 2 or leg rest 4). Moreover, when the massaging machine is provided with a massage course for treating the lower body, the effect of treatment to the lower body as the overall course can be improved by performing the massage to the outer side of the back of the hand while the lower body massage course is being performed.

As described above, by separating the air cells 34, 35 for pressing the back of the hand to the inner side and outer side, and independently expanding the respective air cells 34, 35, it is possible to press only one side of the back of the hand. When only one side of the back of the hand is pressed, in comparison to pressing the overall back of the hand, local sensitivity will be generated, and the pressure point can be effectively stimulated.

Further, even if only one side of the arm or hand is pressed, since the support 22 has a side face portion 24 at both sides of the armrest 7, it is possible to prevent the arm or hand from slipping to the side.

Although the arm and hand massager 20 is provided to the tip of the armrest 7 so as to massage the palm or back of the hand, since the armrest 7 moves backward in conjunction with the backrest 3 being reclined backward, the arm and hand massager 20 will also move backward. Therefore, even when the backrest 3 is reclined and the massagee is in a recumbent state, the massagee is still able to receive a massage to one's arm (hand) with the arm and hand massager 20. As described above, so as long as the armrest 7 itself is capable of moving forward and backward, even if the arm and hand massager 20 is provided to the armrest 7 in a positionally fixed manner, the forward and backward position of the massager 20 can be adjusted by moving the armrest 7 forward and backward. Incidentally, the massager 20 may also be provided movably to the armrest 7 forward and backward.

Figure 13:
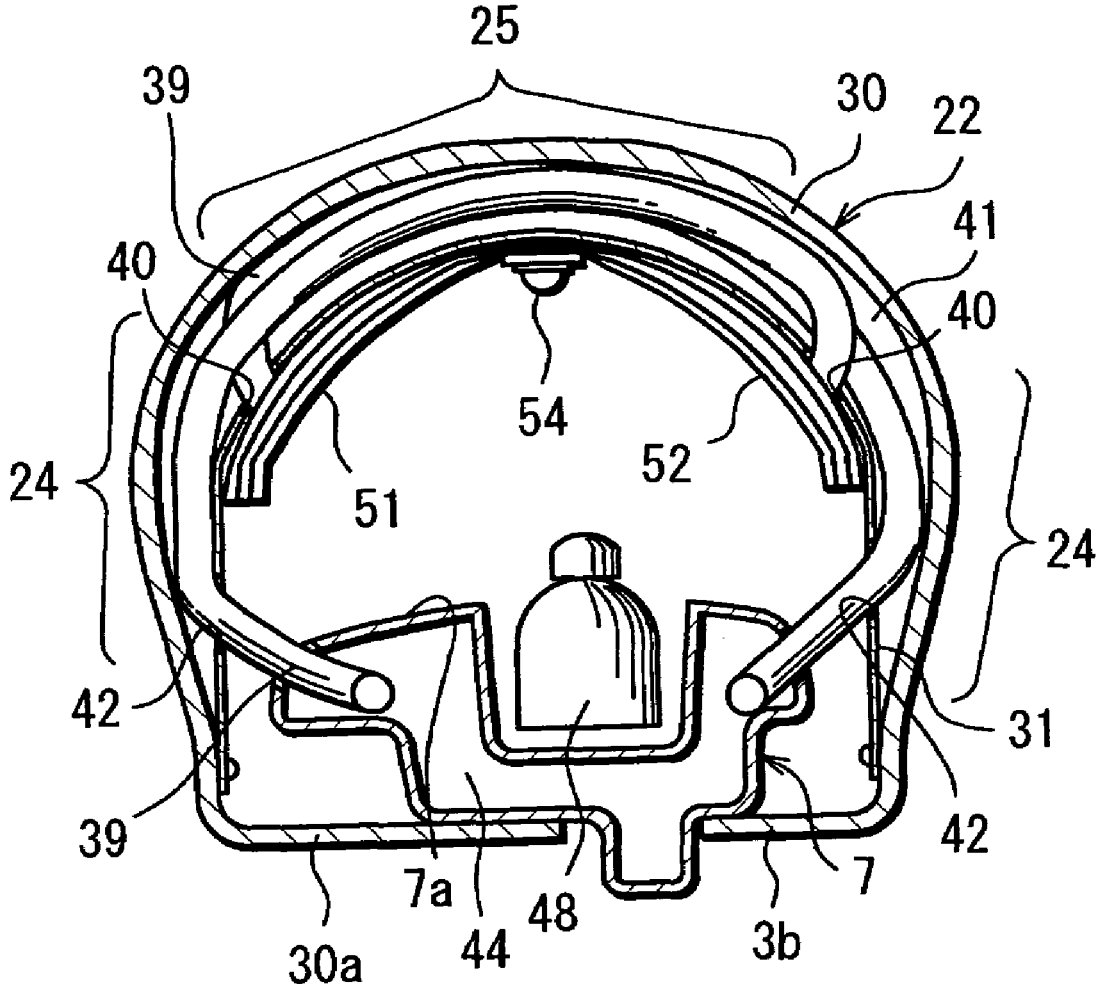
FIG. 13 is a cross section of a massager pertaining to a modified example.
Figure 14:
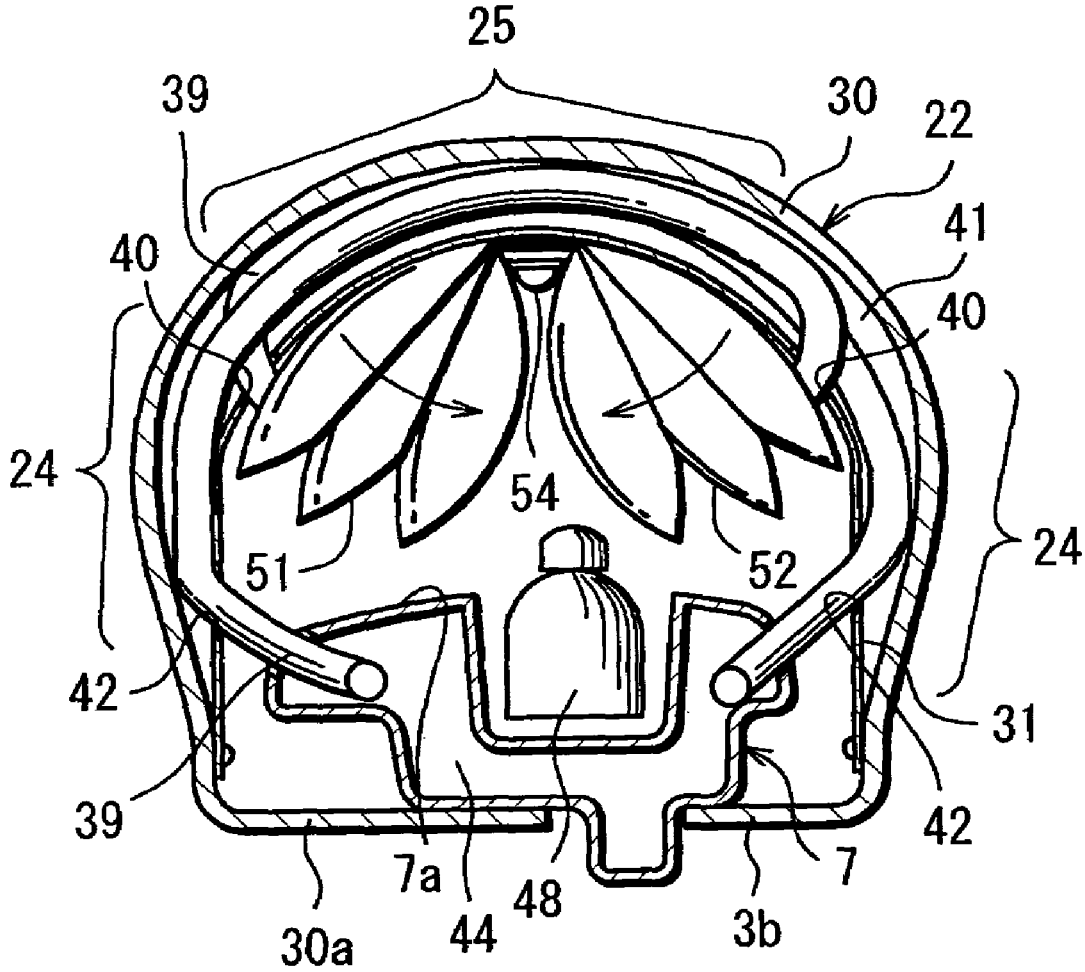
FIG. 14 is a cross section showing a massager (expansion of air cell) pertaining to a modified example.

FIG. 13 and FIG. 14 show modified examples of the massager 20. With this massager 20, left and right air cells 51, 52 are provided to the internal member 31, and the upper parts of the air cells 51, 52 are mounted on the top of the internal member 31 with the fixture 54, and the lower parts of the air cells 51, 52 are freely expandable ends. As shown in FIG. 13, when the air cells 51, 52 expand, the arm or hand (back of the hand) is massaged from the left and right sides while being pressed downward. Therefore, the arm or hand can be massaged from the left and right sides while preventing the arm or hand from slipping.

Figure 15:
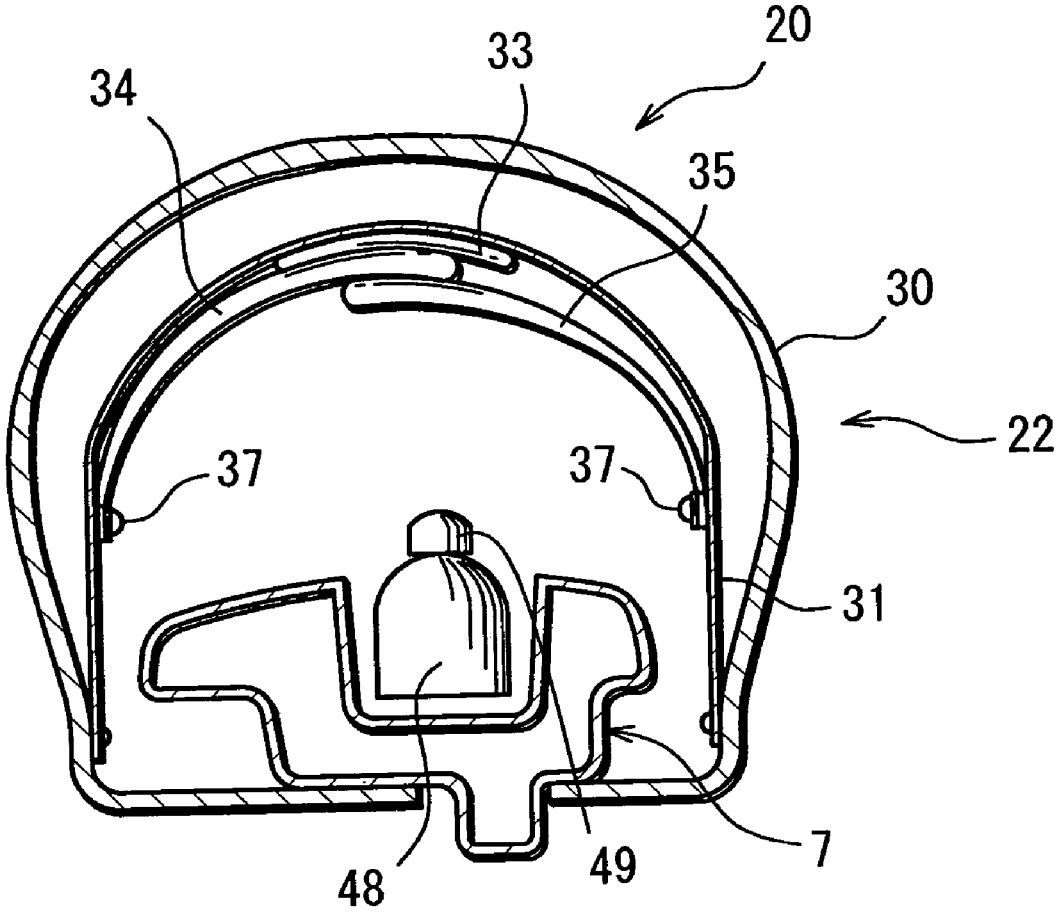
FIG. 15 is a cross section showing a massager (expansion of air cell) pertaining to a modified example.

FIG. 15 shows another modified example of the massager 20. Incidentally, although FIG. 15 onward are diagrams illustrated upon omitting the details such as the air pipe, unless specifically explained, these have the same constitution as the massager 20 described above.

The massager 20 shown in FIG. 15 is constituted such that the left and right second air cells 34, 35 overlap at the free ends thereof. The first air cell 33 is also overlapped at the position where the second air cells 34, 35 are overlapping, and constituted such that the amount of expansion at the position where these air cells 33, 34, 35 overlap will become great. Thus, the pressing strength against the left, right and center portions of the back of the hand can be increased, and a strong massage can be performed.

Figure 16:
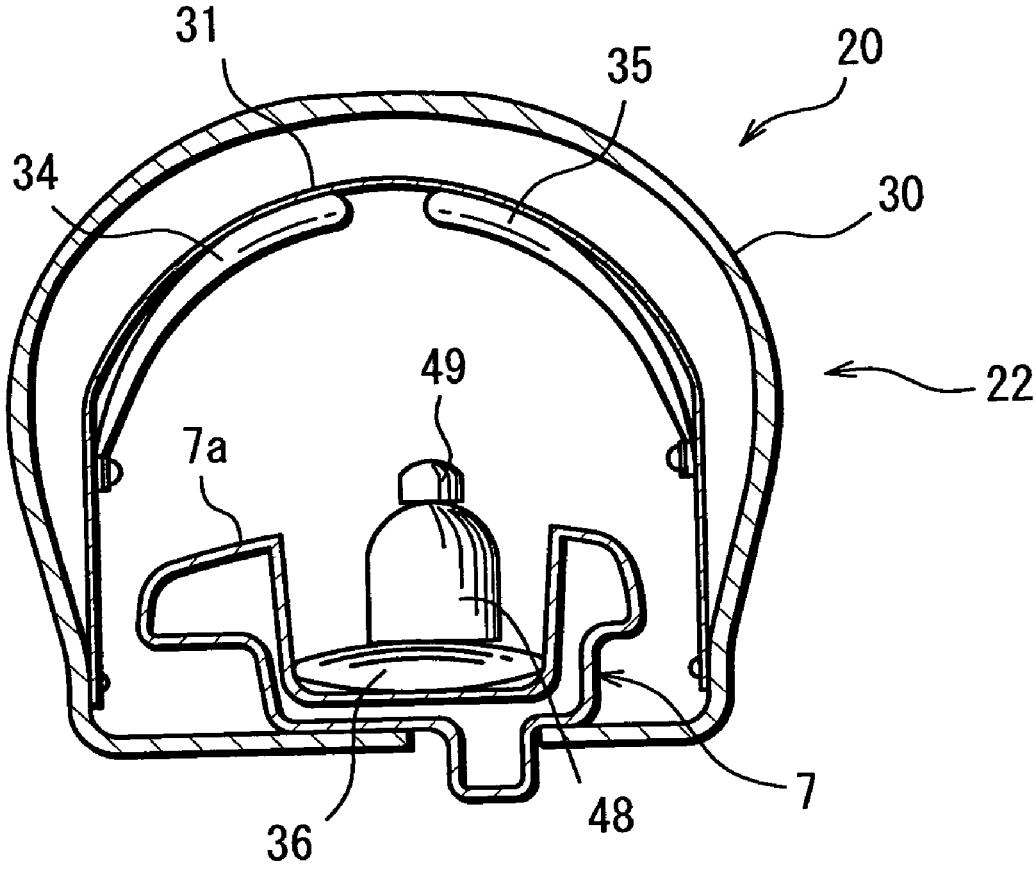
FIG. 16 is a cross section showing a massager (expansion of air cell) pertaining to a modified example.

FIG. 16 shows another modified example of the massager 20. This massager 20, instead of being provided with a first air cell 33, has a third air cell 36 on the armrest 7 side. The third air cell 36 is disposed at the lower side of the vibration generator 48 (acupressure element 49), and, by expanding, it presses the vibration generator 48 (acupressure element 49) upward.

As a result of the vibration generator 48 (acupressure element 49) moving upward, since the amount of protrusion in relation to the upper face 7*a* of the armrest will increase, a vibration massage or acupressure can be effectively performed while pressing the vibration generator 48 (acupressure element 49) downward against the arm or hand. Incidentally, upon contracting the third air cell 36, the vibration generator 48 (acupressure element 49) may be disposed at a position lower than the upper face 7*a* of the armrest.

The third air cell 33 may be provided to the upper face 7*a* of the armrest; that is, to the upper side of the vibration generator 48 (acupressure element 49). Here, the third air cell 33 will mainly function to press the arm or hand downward, and, by simultaneously performing the downward pressing with the second air cells 34, 35 and the downward pressing with the third air cell 36, the arm or hand can be massaged while being squeezed from the top and bottom. In addition, since both the upper side and lower side of the arm or hand are pressed with the air cells 34, 35, 36, a massage feeling of the arm or hand being encompassed can be obtained.

Figure 17:
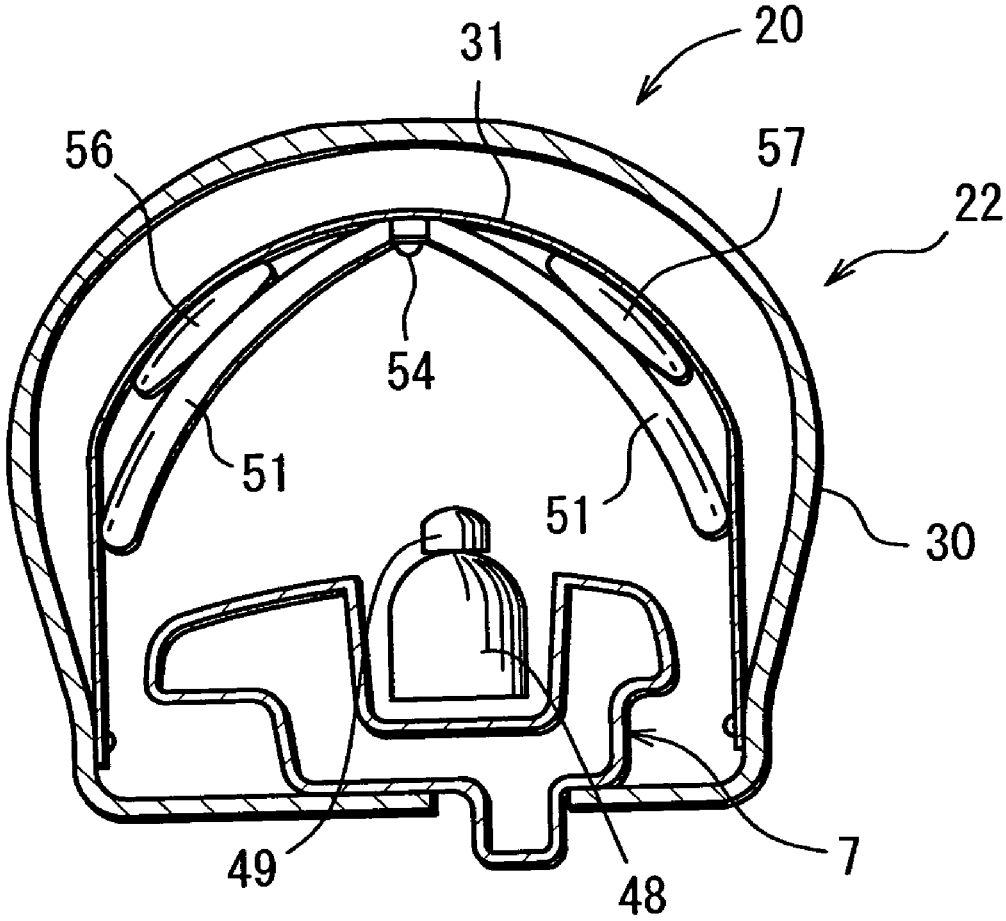
FIG. 17 is a cross section showing a massager (expansion of air cell) pertaining to a modified example.

FIG. 17 shows another modified example of the massager 20. With this massager 20, air cells 56, 57 are additionally disposed, respectively, behind the air cells 51, 52 in the massager 20 depicted in FIG. 13 and FIG. 14. The air cells 56, 57 assist the expansion of the air cells 51, 52, and are constituted to increase the overall amount of expansion so as to powerfully hold the arm or hand.

Figure 18:
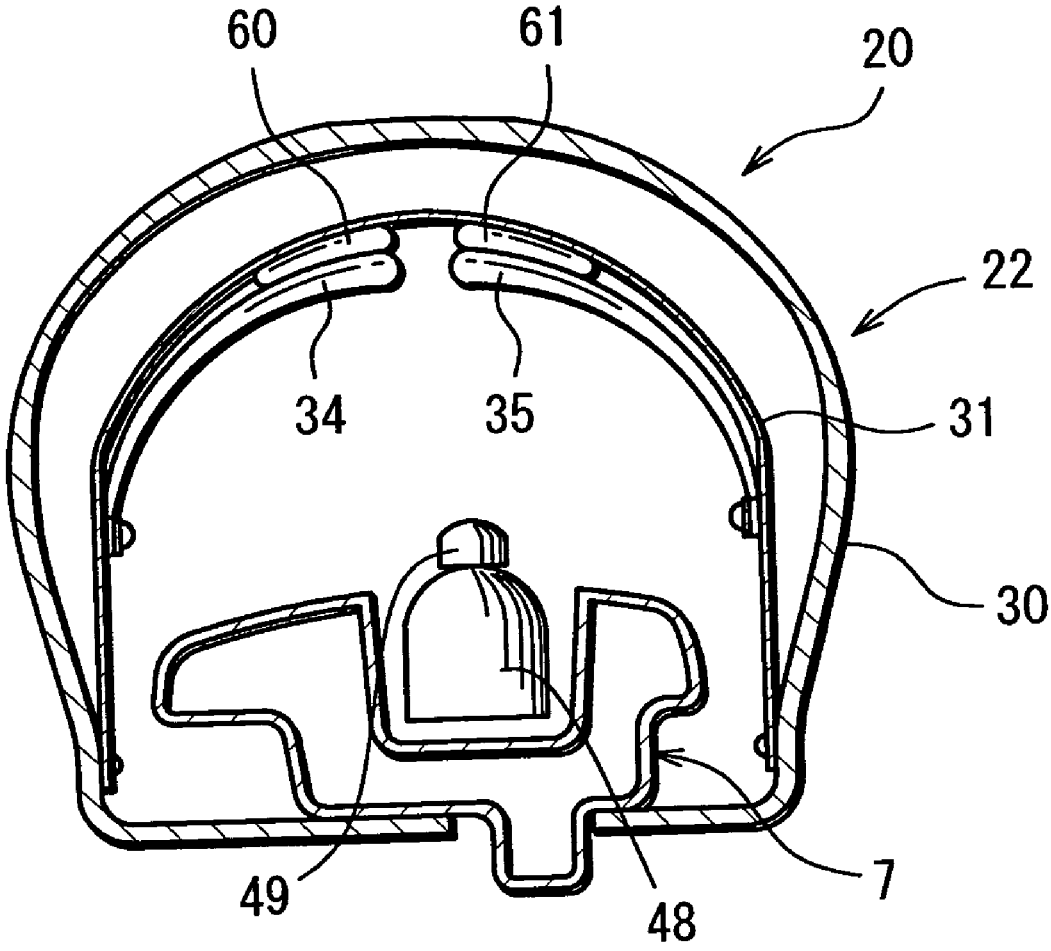
FIG. 18 is a cross section showing a massager (expansion of air cell) pertaining to a modified example.

FIG. 18 shows another modified example of the massager 20. With this massager 20, provided are first air cells 60, 61 in which the first air cell 33 in the massager 20 depicted in FIG. 9 and FIG. 10 is separated to the left and right. When the left and right first air cells 60, 61 simultaneously expand, in addition to functioning as with the first air cell 33, if the left and right first air cells 60, 61 independently expand, massaging of one side of the back of the hand with the second air cells 34, 35 can be independently assisted, and the pressing strength of the one-side massage can be independently increased.

Further, when simultaneously expanding the left and right second air cells 34 to press the back of the hand, by expanding/contracting either the left or right first air cell, the pressing strength against the outer side and the pressing strength against the inner side of the back of the hand will result in differences, and the feeling of massaging one side of the back of the hand can be experienced.

Figure 19:
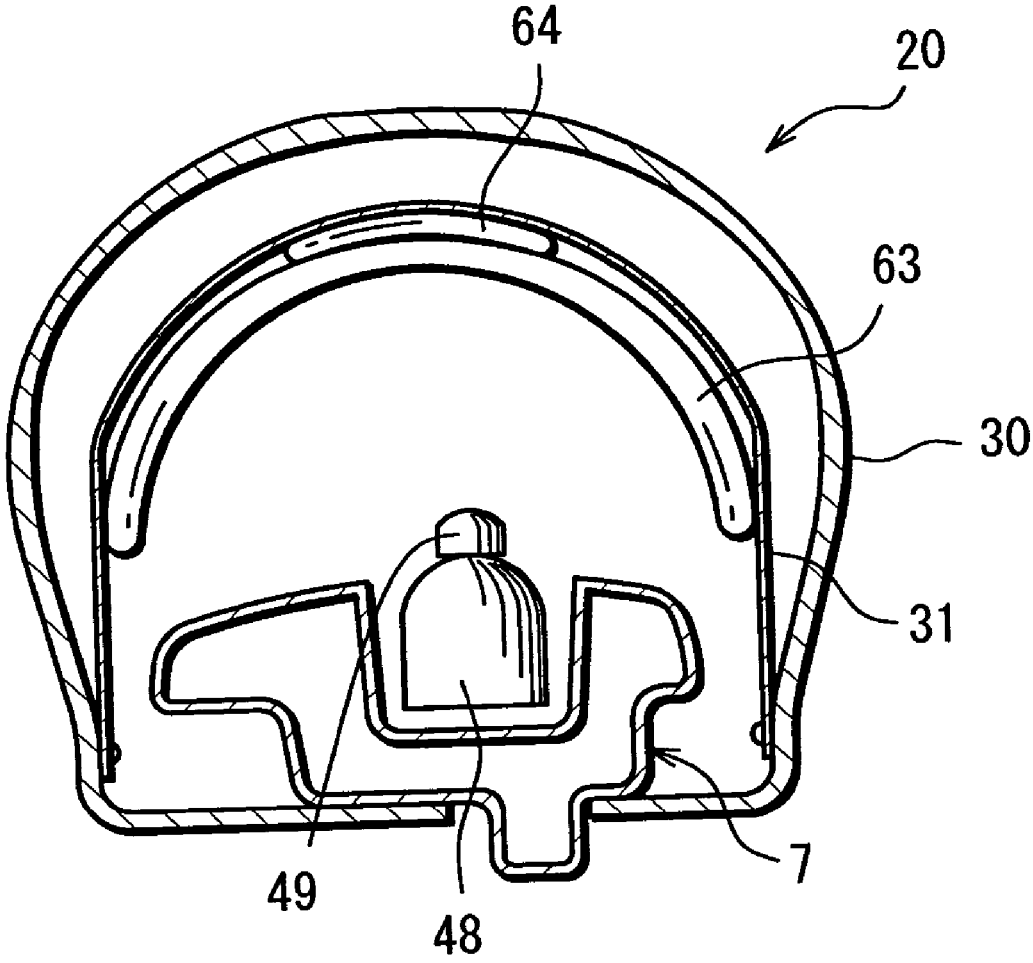
FIG. 19 is a cross section showing a massager (expansion of air cell) pertaining to a modified example.

FIG. 19 shows another modified example of the massager 20. With this massager 20, as the air cell, provided are an air cell 63 of a size corresponding to the approximate overall width of the inner face of the internal member 31, and an air cell 64 disposed therebehind. The air cell 63 presses the arm or hand downward while encompassing the overall arm or hand. Moreover, the air cell 64 is disposed at the center position in the horizontal direction, and, by assisting the downward pressing, increases the amount of expansion of the center position in the horizontal direction.

Figure 20:
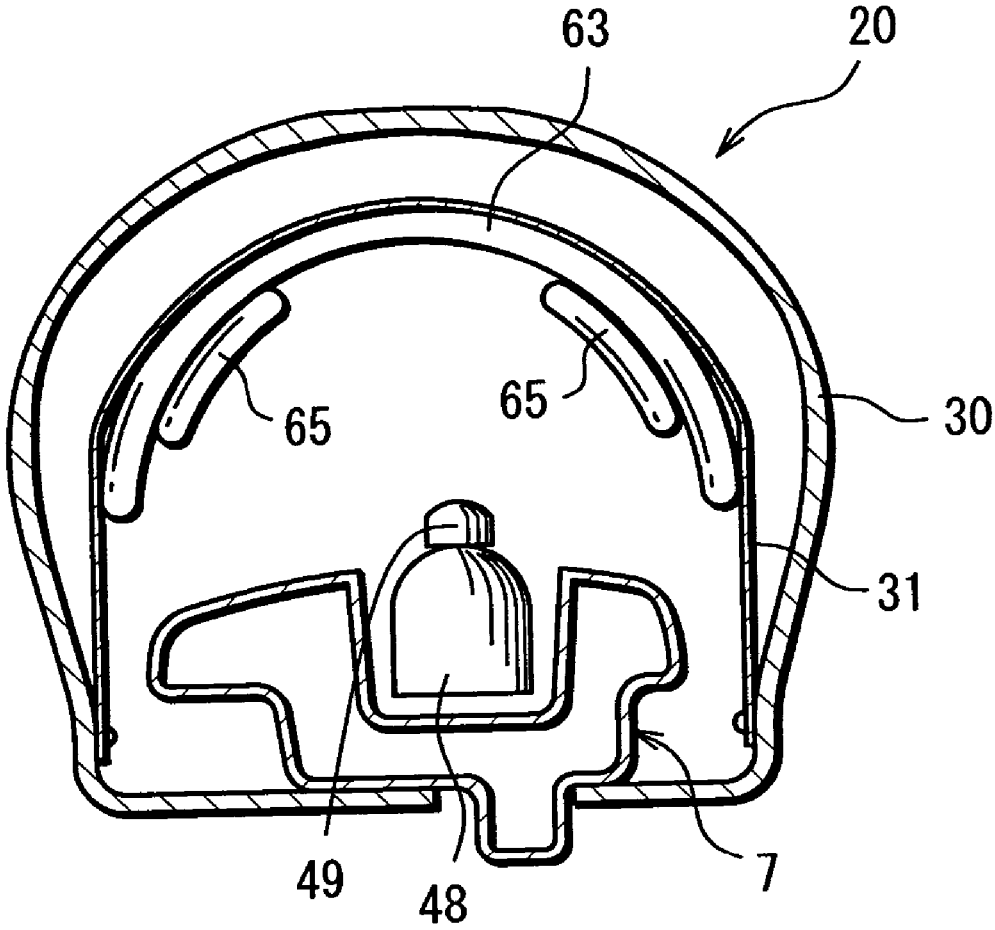
FIG. 20 is a cross section showing a massager (expansion of air cell) pertaining to a modified example.

FIG. 20 shows another modified example of the massager 20. With this massager 20, as the air cell, provided is an air cell 63 of a size corresponding to the approximate overall width of the inner face of the internal member 31 for pressing the arm or hand downward while encompassing the overall arm or hand. Further, as the other air cells, air cells 65, 65 separated to the left and right are provided, and a squeeze massage of the arm or hand from the left and right sides or the one-side massage of the back of the hand can be performed.

Incidentally, as the air cell, it is not necessary to provide it separately from the internal member 31 (support 22), and air may be supplied to the space formed between the inner face of the internal member 31 (support 22) and the fabric attached to such inner face of the internal member 31 (support 22) so as to expand/contract such fabric.

In addition, the length of the support 22 in the cross direction may be arbitrarily set. The massaging point is not limited to the palm or back of the hand, and massaging may be performed to the fingers, or to an area closer to the shoulder than the wrist.

Further, the disposition and quantity of air cells provided to the support 22 may be suitably changed.

The invention claimed is:

1. A massaging machine, comprising:

a chair body having a seat and a backrest;

an armrest provided to the side of said seat;

a tunnel-shaped support provided to stand from said armrest so as to enable the massagee's arm or hand placed on said armrest to be inserted therein; and a massage air cell provided to the inner surface of said tunnel-shaped support which expands/contracts according to the supply/discharge of airs, wherein said tunnel-shaped support has an arch shape extending from side to side of said armrest such that the tunnel-shaped support strides from side to side over the massagee's arm or hand.

2. A massaging machine according to claim 1, wherein said tunnel-shaped support is open at both ends of the cross direction thereof, and the arm or hand can be inserted into the rear opening, and the fingertips can come out from the front opening.

3. A massaging machine according to claim 1, wherein said massage air cell is capable of pressing the arm or hand against said armrest by expanding.

4. A massaging machine according to claim 1, wherein said armrest is provided with an acupressure element for performing acupressure to the arm or hand being pressed with said massage air cell.

5. A massaging machine according to claim 1, wherein said armrest is provided with a vibration generator for performing vibration massage to the arm or hand being pressed by said massage air cell.

6. A massaging machine according to claim 1, wherein said tunnel-shaped support has a tunnel-shaped external member, and an internal member provided inside said external member while retaining space between said external member;

said massage air cell is installed to said internal member; and the space between said external member and said internal member is pipe space for installing a pipe for supplying air to said massage air cell.

7. A massaging machine according to claim 1, wherein said tunnel-shaped support is provided movably forward and backward.

8. A massaging machine according to claim 7, wherein said armrest moves backward in conjunction with the motion of said backrest reclining backward, and moves forward in conjunction with the motion of said backrest rising forward; and said tunnel-shaped support moves forward and backward according to the forward and backward movement of said armrest.

9. A massaging machine according to claim 1, wherein said massage air cell is disposed so as to press the palm or back of the hand placed on said armrest.

10. A massaging machine according to claim 1, wherein the length of the cross direction of said tunnel-shaped support is set to an extent such that only the anterior portion of the massagee's wrist is positioned therein; and said massage air cell is used for massaging the palm or back of the hand.

11. A chair-type massaging machine having an armrest comprising:

an air cell at the upper side of the armrest which expands/contracts according to the supply/discharge of air, and a tunnel-shaped support provided to stand from said armrest so as to enable a massagee's arm or hand placed on said armrest to be inserted therein;

wherein said air cell is provided so as to press the massagee's arm or hand placed on said armrest against said armrest by expanding downward, and wherein said tunnel-shaped support has an arch shape extending from side to side of said armrest such that the tunnel-shaped support strides from side to side over the massagee's arm or hand.

12. An arm and hand massager to be used upon being mounted on the armrest of a chair, comprising:

a tunnel-shaped support mounted on said armrest so as to enable the massagee's arm or hand placed on said armrest to be inserted therein; and an air cell provided to the inner surface of said tunnel-shaped support for massaging the arm or hand by expanding/contracting, wherein said tunnel-shaped support has an arch shape extending from side to side of said armrest such that the tunnel-shaped support strides from side to side over the massagee's arm or hand.

13. A massaging method, comprising:

pressing massagee's arm or hand, placed on an armrest of a chair-type massaging machine having said armrest, against said armrest with an air cell which expands/contracts according to a supply/discharge of air, wherein said air cell is provided on an inner surface of a tunnel-shaped support having an arch shape extending from side to side of the armrest such that said tunnel-shaped support strides over the massage's arm or hand from side to side.

14. A massaging machine according to claim 1, wherein said massage air cell is configured to press the massagee's arm or hand, placed on said armrest, against said armrest from both sides thereof by expanding.

15. A massaging machine according to claim 1, wherein said massage air cell includes an outer air cell and an inner air cell, wherein said outer air cell is positioned at a pinky finger side of the massagee's arm or hand placed on said armrest, and wherein said inner air cell is positioned at a thumb side of the massagee's arm or hand.

16. A massaging machine according to claim 1, wherein said massage air cell has a lower portion mounted to an inner side surface of the tunnel-shaped support and a freely expandable upper portion.

17. A massaging machine according to claim 1, further comprising:

a vibration generator provided to said armrest for giving, via an acupressure element, a vibration massage to the massagee's arm or hand placed on said armrest; and a second air cell for pressing said vibration generator upward by expanding.

18. A massaging machine according to claim 1, wherein said tunnel-shaped support is positioned backward of the front end of said armrest, and the front end of the upper face of said armrest has a downward inclined face.

19. A massaging machine according to claim 1, wherein said tunnel-shaped support includes left and right side face portions at both sides in the width direction of said armrest and extending upward of said armrest and an upper face portion connecting said left and right side face portions above said armrests, and wherein said left and right side face portions and said upper face portion form a continuous arc shape.

* * * * *